US011138932B2

(12) United States Patent
Feng

(10) Patent No.: US 11,138,932 B2
(45) Date of Patent: Oct. 5, 2021

(54) PIXEL CURRENT DETECTION CIRCUIT AND METHOD, AND DISPLAY DEVICE

(71) Applicants: HEFEI XINSHENG OPTOELECTRONICS TECHNOLOGY CO., LTD., Anhui (CN); BOE TECHNOLOGY GROUP CO., LTD., Beijing (CN)

(72) Inventor: Xuehuan Feng, Beijing (CN)

(73) Assignees: HEFEI XINSHENG OPTOELECTRONICS TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 75 days.

(21) Appl. No.: 16/634,397

(22) PCT Filed: Jul. 26, 2019

(86) PCT No.: PCT/CN2019/097857
§ 371 (c)(1),
(2) Date: Jan. 27, 2020

(87) PCT Pub. No.: WO2020/020331
PCT Pub. Date: Jan. 30, 2020

(65) Prior Publication Data

US 2021/0217361 A1 Jul. 15, 2021

(30) Foreign Application Priority Data

Jul. 27, 2018 (CN) ..... 201810845464.0

(51) Int. Cl.
*G09G 3/3233* (2016.01)
*G09G 3/3275* (2016.01)
*G09G 3/20* (2006.01)

(52) U.S. Cl.
CPC ..... *G09G 3/3233* (2013.01); *G09G 3/2092* (2013.01); *G09G 3/3275* (2013.01);
(Continued)

(58) Field of Classification Search
CPC .. G09G 3/3233; G09G 3/2092; G09G 3/3275; G09G 2310/0294; G09G 2330/12; G09G 2300/0426; G09G 2310/0291
See application file for complete search history.

(56) References Cited

U.S. PATENT DOCUMENTS

2011/0205250 A1* 8/2011 Yoo ..... G09G 3/3233 345/690
2012/0169704 A1* 7/2012 Chung ..... G09G 3/3233 345/212

(Continued)

FOREIGN PATENT DOCUMENTS

CN 106531041 A 3/2017
CN 107293239 A 10/2017
CN 107924660 A 4/2018
CN 107945722 A 4/2018

(Continued)

OTHER PUBLICATIONS

First Office Action for Chinese Application No. 201810845464.0, dated Apr. 20, 2020, 5 Pages.
International Search Report and Written Opinion for Application No. PCT/CN2019/097857, dated Oct. 24, 2019, 9 Pages.

*Primary Examiner* — Christopher J Kohlman
(74) *Attorney, Agent, or Firm* — Brooks Kushman P.C.

(57) ABSTRACT

The present disclosure provides a pixel current detection circuit, a pixel current detection method, and a display device. The pixel current detection circuit includes: a pixel current conversion circuit which obtains a first pixel current, a second pixel current and a third pixel current according to an input pixel current to be detected, wherein a ratio of the first pixel current to the second pixel current and a ratio of the second pixel current to the third pixel current are (Continued)

predetermined values; and a current detection circuit which is connected to the pixel current conversion circuit, converts the first pixel current into a first detection voltage, the second pixel current into a second detection voltage, and the third pixel current into a third detection voltage, and determines the pixel current according to the first detection voltage, the second detection voltage and the third detection voltage.

19 Claims, 7 Drawing Sheets

(52) U.S. Cl.
CPC ..... *G09G 2300/0426* (2013.01); *G09G 2310/0291* (2013.01); *G09G 2310/0294* (2013.01); *G09G 2330/12* (2013.01)

(56) References Cited

U.S. PATENT DOCUMENTS

| | | | | |
|---|---|---|---|---|
| 2016/0078805 | A1* | 3/2016 | Woo | G09G 3/3225 345/78 |
| 2016/0203760 | A1 | 7/2016 | Kwon et al. | |
| 2017/0039933 | A1* | 2/2017 | Shin | G09G 3/3225 |
| 2017/0039939 | A1* | 2/2017 | Chaji | G09G 3/3225 |
| 2017/0084227 | A1* | 3/2017 | Bae | G09G 3/3225 |
| 2017/0294159 | A1* | 10/2017 | Lee | H01L 27/3248 |
| 2018/0061913 | A1* | 3/2018 | Kim | H01L 27/3244 |
| 2018/0174522 | A1* | 6/2018 | Lee | G09G 3/3258 |
| 2018/0226006 | A1* | 8/2018 | Wang | H01L 27/3262 |
| 2019/0035335 | A1* | 1/2019 | Kim | G09G 3/3291 |

FOREIGN PATENT DOCUMENTS

| | | | |
|---|---|---|---|
| CN | 108320703 | A | 7/2018 |
| CN | 109935182 | A | 6/2019 |

* cited by examiner

PIXEL CURRENT DETECTION CIRCUIT AND METHOD, AND DISPLAY DEVICE

CROSS-REFERENCE TO RELATED APPLICATIONS

This application is the U.S. national phase of PCT Application No. PCT/CN2019/097857 filed on Jul. 26, 2019, which claims priority to Chinese Patent Application No. 201810845464.0 filed on Jul. 27, 2018, which are incorporated herein by reference in their entireties.

TECHNICAL FIELD

The present disclosure relates to the field of display technology, and in particular to a pixel current detection circuit, a pixel current detection method, and a display device.

BACKGROUND

In the design of an Active-Matrix Organic Light Emitting Diode (AMOLED) display panel, due to the instability of the device, an external compensation circuit is typically provided to compensate for the threshold voltage shift and change in mobility of the device. When the pixel current is detected in the external compensation circuit, an integration circuit composed of a differential operational amplifier is required. The external compensation technology detects the electrical characteristics of a driving transistor, corrects the data voltage based on the detection result, and compensates for the differences in the electrical characteristics of the driving transistor.

In the related art, in order to detect the electrical characteristics of the driving transistor, a current detection circuit is installed in a source driver. The pixel current flowing through the driving transistor when the light emitting element emits light is detected directly by the current detection circuit, and the pixel current is accumulated for a specified amount of time by an integrator connected to an external compensation line and is converted to a detection voltage. The detection voltage is sampled by using an Analog-to-Digital Converter (ADC) to obtain a digital sensing value. The ADC is a device that converts analog signals into digital signals. The input voltage range of the ADC is fixed. When the pixel current is too large, the ADC cannot detect it (for example, in a case that the maximum input voltage that the ADC can read is 5V, when the input terminal of the ADC receives a detection voltage higher than 5V, the digital voltage output by the ADC still corresponds to 5V, which means that the ADC cannot sample an excessive detection voltage). When the pixel current is too small, the voltage detected by the ADC will be inaccurate.

SUMMARY

The present disclosure provides a pixel current detection circuit which is applied to a pixel circuit and configured to detect a pixel current in the pixel circuit. The pixel current detection circuit includes:

a pixel current conversion circuit which obtains a first pixel current, a second pixel current and a third pixel current according to an input pixel current to be detected, wherein a ratio of the first pixel current to the second pixel current and a ratio of the second pixel current to the third pixel current are predetermined values; and a current detection circuit connected to the pixel current conversion circuit, the current detection circuit converts the first pixel current into a first detection voltage, converts the second pixel current into a second detection voltage, and converts the third pixel current into a third detection voltage, and determines the pixel current according to the first detection voltage, the second detection voltage and the third detection voltage.

Optionally, the first pixel current is less than the pixel current, the third pixel current is greater than the pixel current;

the current detection circuit is configured to convert the first pixel current into a first detection voltage, and convert the third pixel current into a third detection voltage.

Optionally, the current detection circuit includes a first conversion sub-circuit, a second conversion sub-circuit, a third conversion sub-circuit, and a detection sub-circuit;

the first conversion sub-circuit is connected to the pixel current conversion circuit to receive the first pixel current, and converts the first pixel current into the first detection voltage;

the second conversion sub-circuit is connected to the pixel current conversion circuit to receive the second pixel current, and converts the second pixel current into the second detection voltage;

the third conversion sub-circuit is connected to the pixel current conversion circuit to receive the third pixel current, and converts the third pixel current into the third detection voltage;

the detection sub-circuit is connected with the first, second and third conversion sub-circuits, and is configured to determine the pixel current according to the first, second and third detection voltages.

Optionally, the detection sub-circuit further includes an analog-to-digital converter, a comparator, and a pixel current acquisition circuit;

the analog-to-digital converter is configured to sample the first detection voltage in a first sampling period of a sampling stage and convert the first detection voltage into a first digital voltage, to sample the second detection voltage in a second sampling period of the sampling stage and convert the second detection voltage into a second digital voltage, and to sample the third detection voltage in a third sampling period of the sampling stage and convert the third detection voltage into a third digital voltage;

the comparator is configured to compare the second digital voltage with a predetermined maximum digital voltage and with a predetermined minimum digital voltage, and to output the first digital voltage when the second digital voltage is higher than the predetermined maximum digital voltage, to output the third digital voltage when the second digital voltage is lower than the predetermined minimum digital voltage, and to output the second digital voltage when the second digital voltage is higher than or equal to the predetermined minimum digital voltage and lower than or equal to the predetermined maximum digital voltage;

the pixel current acquisition circuit is configured to calculate the pixel current according to an output result of the comparator.

Optionally, the pixel current conversion circuit includes a first pixel current output terminal for outputting the first pixel current;

the first conversion sub-circuit includes a first differential operational amplifier, a first storage capacitor, a second storage capacitor, a first switch, a second switch, and a third switch; the detection sub-circuit further includes a first initialization circuit;

an inverting input terminal of the first differential operational amplifier is connected to the first pixel current output terminal, a non-inverting input terminal of the first differential operational amplifier is connected to a reference voltage input terminal; the reference voltage input terminal is used to input a reference voltage;

the first switch and the first storage capacitor are connected in parallel between the inverting input terminal of the first differential operational amplifier and an output terminal of the first differential operational amplifier;

the output terminal of the first differential operational amplifier is connected to a first terminal of the second switch, a second terminal of the second switch is connected to a first terminal of the third switch, a second terminal of the third switch is connected to the analog-to-digital converter;

a first terminal of the second storage capacitor is connected to the second terminal of the second switch, a second terminal of the second storage capacitor is connected to a first voltage input terminal;

the first initialization circuit is configured to provide the reference voltage to the inverting input terminal of the first differential operational amplifier and/or the output terminal of the first differential operational amplifier in an initial stage;

the first switch is configured to turn on or turn off a connection between the inverting input terminal of the first differential operational amplifier and the output terminal of the first differential operational amplifier;

the second switch is configured to turn on or turn off a connection between the output terminal of the first differential operational amplifier and the first terminal of the second storage capacitor;

the third switch is configured to turn on or turn off a connection between the first terminal of the second storage capacitor and the analog-to-digital converter.

Optionally, the first switch is configured to turn on, in the initial stage, the connection between the inverting input terminal of the first differential operational amplifier and the output terminal of the first differential operational amplifier, and to turn off, in an integration stage and the sampling stage, the connection between the inverting input terminal of the first differential operational amplifier and the output terminal of the first differential operational amplifier;

the second switch is configured to turn on, in the initial stage and the integration stage, the connection between the output terminal of the first differential operational amplifier and the first terminal of the second storage capacitor, and to turn off, in the sampling stage, the connection between the output terminal of the first differential operational amplifier and the first terminal of the second storage capacitor;

the third switch is configured to turn off, in the initial stage, the integration stage and the sampling stage except for the first sampling period, the connection between the first terminal of the second storage capacitor and the analog-to-digital converter, and to turn on the connection between the first terminal of the second storage capacitor and the analog-to-digital converter in the first sampling period.

Optionally, the pixel current conversion circuit includes a second pixel current output terminal for outputting the second pixel current;

the second conversion sub-circuit includes a second differential operational amplifier, a third storage capacitor, a fourth storage capacitor, a fourth switch, a fifth switch, and a sixth switch; the detection sub-circuit further includes a second initialization circuit;

an inverting input terminal of the second differential operational amplifier is connected to the second pixel current output terminal, a non-inverting input terminal of the second differential operational amplifier is connected to a reference voltage input terminal; the reference voltage input terminal is used to input a reference voltage;

the fourth switch and the third storage capacitor are connected in parallel between the inverting input terminal of the second differential operational amplifier and an output terminal of the second differential operational amplifier;

the output terminal of the second differential operational amplifier is connected to a first terminal of the fifth switch, a second terminal of the fifth switch is connected to a first terminal of the sixth switch, a second terminal of the sixth switch is connected to the analog-to-digital converter;

a first terminal of the fourth storage capacitor is connected to the second terminal of the fifth switch, a second terminal of the fourth storage capacitor is connected to a first voltage input terminal;

the second initialization circuit is configured to provide the reference voltage to the inverting input terminal of the second differential operational amplifier and/or the output terminal of the second differential operational amplifier in the initial stage;

the fourth switch is configured to turn on or turn off a connection between the inverting input terminal of the second differential operational amplifier and the output terminal of the second differential operational amplifier;

the fifth switch is configured to turn on or turn off a connection between the output terminal of the second differential operational amplifier and the first terminal of the fourth storage capacitor;

the sixth switch is configured to turn on or turn off a connection between the first terminal of the fourth storage capacitor and the analog-to-digital converter.

Optionally, the fourth switch is configured to turn on, in the initial stage, the connection between the inverting input terminal of the second differential operational amplifier and the output terminal of the second differential operational amplifier, and to turn off, in an integration stage and the sampling stage, the connection between the inverting input terminal of the second differential operational amplifier and the output terminal of the second differential operational amplifier;

the fifth switch is configured to turn on, in the initial stage and the integration stage, the connection between the output terminal of the second differential operational amplifier and the first terminal of the fourth storage capacitor, and to turn off, in the sampling stage, the connection between the output terminal of the second differential operational amplifier and the first terminal of the fourth storage capacitor;

the sixth switch is configured to turn off, in the initial stage, the integration stage and the sampling stage except for the second sampling period, the connection between the first terminal of the fourth storage capacitor and the analog-to-digital converter, and to turn on, in the second sampling period, the connection between the first terminal of the fourth storage capacitor and the analog-to-digital converter.

Optionally, the pixel current conversion circuit includes a third pixel current output terminal for outputting the third pixel current;

the third conversion sub-circuit includes a third differential operational amplifier, a fifth storage capacitor, a sixth storage capacitor, a seventh switch, an eighth switch, and a ninth switch; the detection sub-circuit further includes a third initialization circuit;

an inverting input terminal of the third differential operational amplifier is connected to the third pixel current output terminal, a non-inverting input terminal of the third differential operational amplifier is connected to a reference voltage input terminal; the reference voltage input terminal is used to input a reference voltage;

the seventh switch and the fifth storage capacitor are connected in parallel between the inverting input terminal of the third differential operational amplifier and an output terminal of the third differential operational amplifier;

the output terminal of the third differential operational amplifier is connected to a first terminal of the eighth switch, a second terminal of the eighth switch is connected to a first terminal of the ninth switch, a second terminal of the ninth switch is connected to the analog-to-digital converter;

a first terminal of the sixth storage capacitor is connected to the second terminal of the eighth switch, a second terminal of the sixth storage capacitor is connected to a first voltage input terminal;

the third initialization circuit is configured to provide the reference voltage to the inverting input terminal of the third differential operational amplifier and/or the output terminal of the third differential operational amplifier in the initial stage;

the seventh switch is configured to turn on or turn off a connection between the inverting input terminal of the third differential operational amplifier and the output terminal of the third differential operational amplifier;

the eighth switch is configured to turn on or turn off a connection between the output terminal of the third differential operational amplifier and the first terminal of the sixth storage capacitor;

the ninth switch is configured to turn on or turn off a connection between the first terminal of the sixth storage capacitor and the analog-to-digital converter.

Optionally, the seventh switch is configured to turn on, in the initial stage, the connection between the inverting input terminal of the third differential operational amplifier and the output terminal of the third differential operational amplifier, and to turn off, in an integration stage and the sampling stage, the connection between the inverting input terminal of the third differential operational amplifier and the output terminal of the third differential operational amplifier;

the eighth switch is configured to turn on, in the initial stage and the integration stage, the connection between the output terminal of the third differential operational amplifier and the first terminal of the sixth storage capacitor, and to turn off, in the sampling stage, the connection between the output terminal of the third differential operational amplifier and the first terminal of the sixth storage capacitor;

the ninth switch is configured to turn off, in the initial stage, the integration stage and the sampling stage except for the third sampling period, the connection between the first terminal of the sixth storage capacitor and the analog-to-digital converter, and to turn on the connection between the first terminal of the sixth storage capacitor and the analog-to-digital converter in the third sampling period.

Optionally, the pixel current conversion circuit includes:

an input transistor having a gate and a first electrode connected to the pixel current, and a second electrode connected to a second voltage input terminal;

a first power-supply transistor having a gate and a first electrode connected to a third voltage input terminal;

a first output transistor having a gate connected to the gate of the input transistor, a first electrode connected to a second electrode of the first power-supply transistor, and a second electrode for outputting the first pixel current;

a second power-supply transistor having a gate and a first electrode connected to the third voltage input terminal;

a second output transistor having a gate connected to the gate of the input transistor, a first electrode connected to a second electrode of the second power-supply transistor, and a second electrode for outputting the second pixel current;

a third power-supply transistor having a gate and a first electrode connected to the third voltage input terminal;

a third output transistor having a gate connected to the gate of the input transistor, a first electrode connected to a second electrode of the third power-supply transistor, and a second electrode for outputting the third pixel current;

a ratio of a width-to-length ratio of the first output transistor to a width-to-length ratio of the input transistor is less than 1, and a ratio of a width-to-length ratio of the third output transistor to the width-to-length ratio of the input transistor is greater than 1.

Optionally, a ratio of a width-to-length ratio of the second output transistor to the width-to-length ratio of the input transistor is in a range greater than or equal to 0.99 and less than or equal to 1.01; the ratio of the width-to-length ratio of the first output transistor to the width-to-length ratio of the input transistor is greater than 0 and less than 0.6, and the ratio of the width-to-length ratio of the third output transistor to the width-to-length ratio of the input transistor is greater than 1.5.

The present disclosure further provides a pixel current detection method applied to the above pixel current detection circuit. The pixel current detection method includes:

a current conversion step of converting the pixel current by the pixel current conversion circuit to obtain a first pixel current, a second pixel current and a third pixel current; and a current detection step of converting, by the current detection circuit, the first pixel current into a first detection voltage, the second pixel current into a second detection voltage, and the third pixel current into a third detection voltage, and determining the pixel current according to the first detection voltage, the second detection voltage and the third detection voltage.

Optionally, the first pixel current is less than the second pixel current, the third pixel current is greater than the second pixel current;

the current detection circuit includes a first conversion sub-circuit, a second conversion sub-circuit, a third conversion sub-circuit, and a detection sub-circuit; the current detection step includes:

receiving the first pixel current and converting the first pixel current into the first detection voltage by the first conversion sub-circuit;

receiving the second pixel current and converting the second pixel current into the second detection voltage by the second conversion sub-circuit;

receiving the third pixel current and converting the third pixel current into the third detection voltage by the third conversion sub-circuit;

determining the pixel current according to the first, second and third detection voltages by the detection sub-circuit.

Optionally, the detection sub-circuit includes an analog-to-digital converter, a comparator, and a pixel current acquisition circuit; the step of determining the pixel current according to the first, second and third detection voltages by the detection sub-circuit includes:

sampling the first detection voltage in a first sampling period of a sampling stage and converting the first detection voltage into a first digital voltage by the analog-to-digital converter, sampling the second detection voltage in a second sampling period of the sampling stage and converting the second detection voltage into a second digital voltage by the analog-to-digital converter, and sampling the third detection voltage in a third sampling period of the sampling stage and converting the third detection voltage into a third digital voltage by the analog-to-digital converter;

comparing the second digital voltage with a predetermined maximum digital voltage and with a predetermined minimum digital voltage by the comparator, and outputting the first digital voltage when the second digital voltage is higher than the predetermined maximum digital voltage, outputting the third digital voltage when the second digital voltage is lower than the predetermined minimum digital voltage, and outputting the second digital voltage when the second digital voltage is higher than or equal to the predetermined minimum digital voltage and lower than or equal to the predetermined maximum digital voltage;

calculating the pixel current according to an output result of the comparator by the pixel current acquisition circuit.

Optionally, the first conversion sub-circuit includes a first differential operational amplifier, a first storage capacitor, a second storage capacitor, a first switch, a second switch, and a third switch; the detection sub-circuit further includes a first initialization circuit; a detection time includes an initial stage, an integration stage and a sampling stage arranged in sequence; the sampling stage includes a first sampling period; the step of converting the first pixel current into the first detection voltage by the current detection circuit includes:

in the initial stage, turning on a connection between an inverting input terminal of the first differential operational amplifier and an output terminal of the first differential operational amplifier by the first switch, turning on a connection between the output terminal of the first differential operational amplifier and a first terminal of the second storage capacitor by the second switch; turning off a connection between the first terminal of the second storage capacitor and the analog-to-digital converter by the third switch; and providing a reference voltage to the inverting input terminal of the first differential operational amplifier and/or the output terminal of the first differential operational amplifier by the first initialization circuit;

in the integration stage, turning off the connection between the inverting input terminal of the first differential operational amplifier and the output terminal of the first differential operational amplifier by the first switch, turning on the connection between the output terminal of the first differential operational amplifier and the first terminal of the second storage capacitor by the second switch, turning off the connection between the first terminal of the second storage capacitor and the analog-to-digital converter by the third switch, and charging the first storage capacitor with the first pixel current;

in the sampling stage, turning off the connection between the inverting input terminal of the first differential operational amplifier and the output terminal of the first differential operational amplifier by the first switch, and turning off the connection between the output terminal of the first differential operational amplifier and the first terminal of the second storage capacitor by the second switch; wherein in the first sampling period, the third switch turns on the connection between the first terminal of the second storage capacitor and the analog-to-digital converter, the analog-to-digital converter samples a voltage at the first terminal of the second storage capacitor, which is the first detection voltage; and in the sampling stage except for the first sampling period, the third switch turns off the connection between the first terminal of the second storage capacitor and the analog-to-digital converter.

Optionally, the second conversion sub-circuit includes a second differential operational amplifier, a third storage capacitor, a fourth storage capacitor, a fourth switch, a fifth switch, and a sixth switch; the detection sub-circuit further includes a second initialization circuit; a detection time includes an initial stage, an integration stage and a sampling stage arranged in sequence; the sampling stage further includes a second sampling period;

the step of converting the second pixel current into the second detection voltage by the current detection circuit includes:

in the initial stage, turning on a connection between an inverting input terminal of the second differential operational amplifier and an output terminal of the second differential operational amplifier by the fourth switch, turning on a connection between the output terminal of the second differential operational amplifier and a first terminal of the fourth storage capacitor by the fifth switch; turning off a connection between the first terminal of the fourth storage capacitor and the analog-to-digital converter by the sixth switch; and providing a reference voltage to the inverting input terminal of the second differential operational amplifier and/or the output terminal of the second differential operational amplifier by the second initialization circuit;

in the integration stage, turning off the connection between the inverting input terminal of the second differential operational amplifier and the output terminal of the second differential operational amplifier by the fourth switch, turning on the connection between the output terminal of the second differential operational amplifier and the first terminal of the fourth storage capacitor by the fifth switch, turning off the connection between the first terminal of the fourth storage capacitor and the analog-to-digital converter by the sixth switch, and charging the third storage capacitor with the second pixel current;

in the sampling stage, turning off the connection between the inverting input terminal of the second differential operational amplifier and the output terminal of the second differential operational amplifier by the fourth switch, and turning off the connection between the output terminal of the second differential operational amplifier and the first terminal of the fourth storage capacitor by the fifth switch; wherein in the second sampling period, the sixth switch turns on the connection between the first terminal of the fourth storage capacitor and the analog-to-digital converter, the analog-to-digital converter samples a voltage at the first terminal of the fourth storage capacitor, which is the second detection voltage; and in the sampling stage except for the second sampling period, the sixth switch turns off the connection between the first terminal of the fourth storage capacitor and the analog-to-digital converter.

Optionally, the third conversion sub-circuit includes a third differential operational amplifier, a fifth storage capacitor, a sixth storage capacitor, a seventh switch, an eighth switch, and a ninth switch; the detection sub-circuit further includes a third initialization circuit; a detection time includes an initial stage, an integration stage and a sampling stage arranged in sequence; the sampling stage further includes a third sampling period;

the step of converting the third pixel current into the third detection voltage by the current detection circuit includes:

in the initial stage, turning on a connection between an inverting input terminal of the third differential operational amplifier and an output terminal of the third differential operational amplifier by the seventh switch, turning on a connection between the output terminal of the third differential operational amplifier and a first terminal of the sixth storage capacitor by the eighth switch; turning off a connection between the first terminal of the sixth storage capacitor and the analog-to-digital converter by the ninth switch; and providing a reference voltage to the inverting input terminal of the third differential operational amplifier and/or the output terminal of the third differential operational amplifier by the third initialization circuit;

in the integration stage, turning off the connection between the inverting input terminal of the third differential operational amplifier and the output terminal of the third differential operational amplifier by the seventh switch, turning on the connection between the output terminal of the third differential operational amplifier and the first terminal of the sixth storage capacitor by the eighth switch, turning off the connection between the first terminal of the sixth storage capacitor and the analog-to-digital converter by the ninth switch, and charging the fifth storage capacitor with the third pixel current;

in the sampling stage, turning off the connection between the inverting input terminal of the third differential operational amplifier and the output terminal of the third differential operational amplifier by the seventh switch, and turning off the connection between the output terminal of the third differential operational amplifier and the first terminal of the sixth storage capacitor by the eighth switch; wherein in the third sampling period, the ninth switch turns on the connection between the first terminal of the sixth storage capacitor and the analog-to-digital converter, the analog-to-digital converter samples a voltage at the first terminal of the sixth storage capacitor, which is the third detection voltage;

in the sampling stage except for the third sampling period, the ninth switch turns off the connection between the first terminal of the sixth storage capacitor and the analog-to-digital converter.

The present disclosure further provides a display device including the above pixel current detection circuit; the display device further includes a pixel circuit;

the pixel current detection circuit is configured to detect a pixel current in the pixel circuit.

Optionally, the pixel circuit includes a data writing circuit, an energy storage circuit, a driving circuit, a light emitting element, and a current output control circuit;

a control terminal of the data writing circuit is connected to a first scanning line, a first terminal of the data writing circuit is connected to a data line, a second terminal of the data writing circuit is connected to a control terminal of the driving circuit, and the data writing circuit is configured to turn on or turn off a connection between the data line and the control terminal of the driving circuit under control of the first scanning line;

the energy storage circuit is connected to the control terminal of the driving circuit to control a potential of the control terminal of the driving circuit;

a first terminal of the driving circuit is connected to a power supply voltage terminal, a second terminal of the driving circuit is connected to the light emitting element, and the driving circuit is configured to drive the light emitting element to emit light under control of the control terminal thereof, a control terminal of the current output control circuit is connected to a second scanning line, a first terminal of the current output control circuit is connected to the second terminal of the driving circuit, a second terminal of the current output control circuit is connected to an external compensation line;

the pixel current conversion circuit in the pixel current detection circuit is connected to the external compensation line, and configured to detect the pixel current output from the external compensation line.

DETAILED DESCRIPTION

Figure 1:
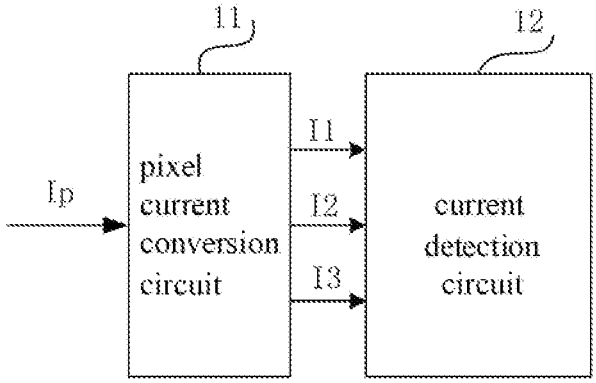
FIG. 1 is a structural block diagram of a pixel current detection circuit according to an embodiment of the present disclosure.

The technical solutions in the embodiments of the present disclosure will be clearly and completely described below with reference to the drawings in the embodiments of the present disclosure. Obviously, the described embodiments are only a part of the embodiments of the present disclosure, but not all of the embodiments. Based on the embodiments in the present disclosure, all other embodiments obtained by a person of ordinary skill in the art without creative efforts shall fall within the protection scope of the present disclosure.

The transistors adopted in the embodiments of the present disclosure may be thin film transistors or field effect transistors or other devices with the same characteristics. In the embodiments of the present disclosure, in order to distinguish the two electrodes of a transistor except the gate, one of the two electrodes is referred to as a first electrode, and the other is referred to as a second electrode. In practice, the first electrode may be a drain, and the second electrode may be a source; alternatively, the first electrode may be a source, and the second electrode may be a drain.

The pixel current detection circuit according to an embodiment of the present disclosure is applied to a pixel circuit and is configured to detect the pixel current in the pixel circuit. The pixel current detection circuit includes:

a pixel current conversion circuit which obtains a first pixel current, a second pixel current and a third pixel current according to an input pixel current to be detected, wherein a ratio of the first pixel current to the second pixel current and a ratio of the second pixel current to the third pixel current are predetermined values; and a current detection circuit which is connected to the pixel current conversion circuit, converts the first pixel current into a first detection voltage, the second pixel current into a second detection voltage, and the third pixel current into a third detection voltage, and determines the pixel current according to the first detection voltage, the second detection voltage and the third detection voltage.

The pixel current detection circuit according to the present disclosure uses the pixel current conversion circuit to convert the pixel current to obtain the first pixel current, the second pixel current and the third pixel current, the current detection circuit obtains the pixel current according to the first detection voltage obtained by converting the first pixel current, the second detection voltage obtained by converting the second pixel current, and the third detection voltage obtained by converting the third pixel current, so that the problem of inaccurate detection results due to the limited detection range of the current detection circuit can be avoided, and the pixel current can be detected accurately, thereby enabling better external compensation.

In practice, the first pixel current is lower than the pixel current to be detected, and the third pixel current is higher than the pixel current to be detected;

the current detection circuit is configured to convert the first pixel current into a first detection voltage, to convert the third pixel current into a third detection voltage.

The pixel current detection circuit according to an embodiment of the present disclosure is applied to a pixel circuit and is configured to detect the pixel current Ip in the pixel circuit. As shown in FIG. 1, the pixel current detection circuit includes:

a pixel current conversion circuit 11 which is configured to convert the pixel current Ip to obtain a first pixel current I1, a second pixel current I2, and a third pixel current I3; the first pixel current I1 is lower than the pixel current Ip, a ratio of the second pixel current I2 to the pixel current Ip is within a predetermined ratio range, and the third pixel current I3 is higher than the pixel current Ip; and a current detection circuit I2 which is connected to the pixel current conversion circuit I1, and is configured to convert the first pixel current I1 into a first detection voltage, the second pixel current I2 into a second detection voltage, and the third pixel current I3 into a third detection voltage, and obtains the pixel current according to at least one of the first detection voltage, the second detection voltage and the third detection voltage.

The pixel current detection circuit according to the embodiment of the present disclosure uses the pixel current conversion circuit to convert the pixel current Ip to obtain the first pixel current I1, the second pixel current I2 and the third pixel current I3; the first pixel current I1 is lower than the pixel current Ip, the ratio of the second pixel current I2 to the pixel current Ip is within a predetermined ratio range, and the third pixel current I3 is higher than the pixel current Ip; the current detection circuit I2 obtains the pixel current according to at least one of the first detection voltage obtained by converting the first pixel current I1, the second detection voltage obtained by converting the second pixel current I2, and the third detection voltage obtained by converting the third pixel current I3, so that the problem of inaccurate detection results due to the limited detection range of the current detection circuit can be avoided, and the pixel current can be detected accurately, thereby enabling better external compensation.

Optionally, when the pixel current Ip is too large, the current detection circuit I2 obtains the pixel current according to the first detection voltage converted from the current I1; when the pixel current Ip is too small, the current detection circuit I2 obtains the pixel current according to the third detection voltage converted from the current I3, so that the pixel current detection result can be accurate.

In some embodiments, the second pixel current I2 is equal to the pixel current Ip.

In an embodiment of the present disclosure, the ratio of the second pixel current I2 to the pixel current Ip is within a predetermined ratio range. The predetermined ratio range may be greater than or equal to 0.99 and less than or equal to 1.01, so that the current I2 and the current Ip are equal or approximately equal.

In practice, the ratio of the first pixel current to the pixel current may be greater than 0 and less than 0.6, and the ratio of the third pixel current to the pixel current may be greater than 1.5.

Optionally, the pixel current conversion circuit I1 includes a first pixel current output terminal, a second pixel current output terminal, and a third pixel current output terminal. The first pixel current output terminal is configured to output the first pixel current I1, the second pixel current output terminal is configured to output the second pixel current I2, and the third pixel current output terminal is configured to output the third pixel current 3.

Figure 2:
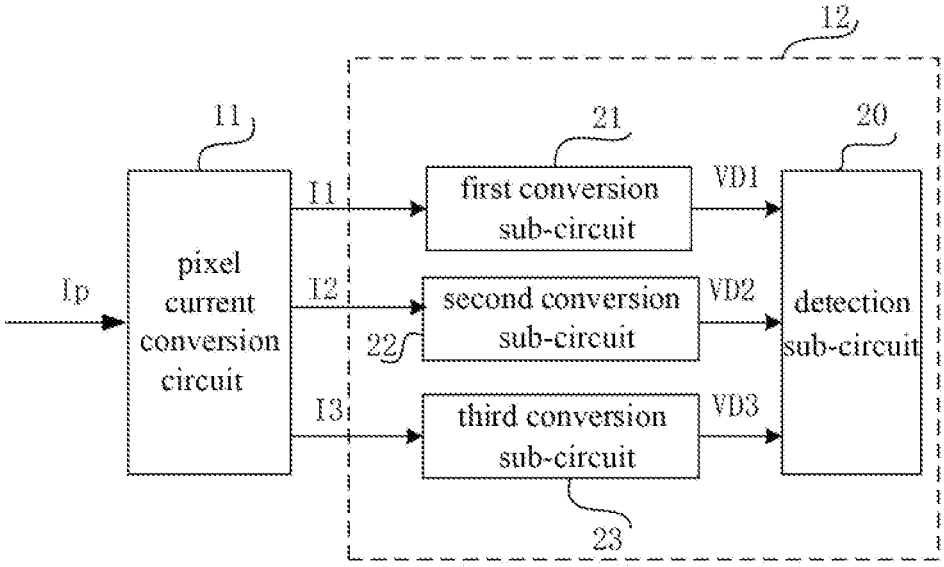
FIG. 2 is a structural block diagram of a pixel current detection circuit according to another embodiment of the present disclosure.

Optionally, as shown in FIG. 2, the current detection circuit I2 may include a first conversion sub-circuit 21, a second conversion sub-circuit 22, a third conversion sub-circuit 23, and a detection sub-circuit 20;

the first conversion sub-circuit 21 is configured to receive the first pixel current I1, and converts the first pixel current I1 into the corresponding first detection voltage VD1;

the second conversion sub-circuit 22 is configured to receive the second pixel current I2, and converts the second pixel current I2 into the corresponding second detection voltage VD2;

the third conversion sub-circuit 23 is configured to receive the third pixel current I3, and converts the third pixel current I3 into the corresponding third detection voltage VD3;

the detection sub-circuit 20 is connected to the first, second and third conversion sub-circuits 21, 22 and 23, and is configured to obtain the pixel current according to at least one of the first, second and third detection voltages VD1, VD2, and VD3.

In practice, the current detection circuit I2 includes a first conversion sub-circuit 21, a second conversion sub-circuit 22, a third conversion sub-circuit 23, and a detection sub-circuit 20, converts the currents I1, I2, and I3 by the first, second and third conversion sub-circuits 21, 22 and 23, respectively, so as to obtain the voltages VD1, VD2, and VD3, and obtains the pixel current by the detection sub-circuit 20 according to at least one of the voltages VD1, VD2, and VD3.

Figure 3:
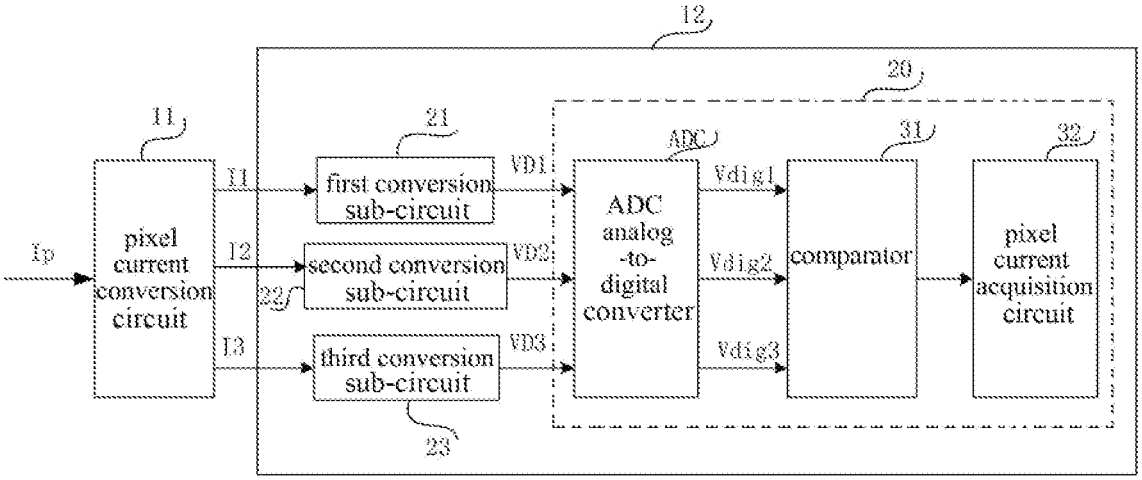
FIG. 3 is a structural block diagram of a pixel current detection circuit according to still another embodiment of the present disclosure.

Optionally, as shown in FIG. 3, on the basis of the embodiment shown in FIG. 2, the detection sub-circuit 20 may include an analog-to-digital converter ADC, a comparator 31, and a pixel current acquisition circuit 32;

the analog-to-digital converter ADC is configured to sample the first detection voltage VD1 in a first sampling period included in a sampling stage and convert the first detection voltage VD1 into a first digital voltage Vdig1, to sample the second detection voltage VD2 in a second sampling period included in the sampling stage and convert the second detection voltage VD2 into a second digital voltage Vdig2, and to sample the third detection voltage VD3 in a third sampling period included in the sampling stage and convert the third detection voltage VD3 into a third digital voltage Vdig3;

the comparator 31 is configured to compare the second digital voltage Vdig2 with a predetermined maximum digital voltage Vmax, and compare the second digital voltage Vdig2 with a predetermined minimum digital voltage Vmin. When the second digital voltage Vdig2 obtained by comparing is higher than the predetermined maximum digital voltage Vmax, the comparator 31 transfer the first digital voltage Vdig1 to the pixel current acquisition circuit 32; when the second digital voltage Vdig2 obtained by comparing is lower than the predetermined minimum digital voltage Vmin, the comparator 31 transfer the third digital voltage Vdig3 to the pixel current acquisition circuit 32; when the second digital voltage Vdig2 obtained by comparing is higher than or equal to the predetermined minimum digital voltage Vmin and lower than or equal to the predetermined maximum digital voltage Vmax, the comparator 31 transfer the second digital voltage Vdig2 to the pixel current acquisition circuit 32.

The pixel current acquisition circuit 32 is configured to calculate the pixel current according to the output result of the comparator, i.e., the first, second, or third data voltages Vdig1, Vdig2 or Vdig.3.

When the second detection voltage VD2 is higher than a predetermined maximum input voltage of the analog-to-digital converter ADC, the second digital voltage Vdig2 is higher than the predetermined maximum digital voltage Vmax, and thus the pixel current acquisition circuit 32 obtains the pixel current according to the first digital voltage Vdig1. When the second detection voltage VD2 is lower than a predetermined minimum input voltage of the analog-to-digital converter ADC, the second digital voltage Vdig2 is lower than the predetermined minimum digital voltage Vmin, and thus the pixel current acquisition circuit 32 obtains the pixel current according to the third digital voltage Vdig3. When the second detection voltage VD2 is higher than or equal to the predetermined minimum input voltage and lower than or equal to the predetermined maximum input voltage, the second digital voltage Vdig2 is higher than or equal to the predetermined minimum digital voltage Vmin and lower than or equal to the predetermined maximum digital voltage Vmax, and thus the pixel current acquisition circuit 32 obtains the pixel current according to the second digital voltage Vdig2.

Optionally, the pixel current acquisition circuit 32 may be a processor having a computing function and an analog-to-digital conversion function, and they each may be implemented by a circuit or by using software, hardware (circuit), firmware, or any combination thereof, which is not limited in this embodiment. In practice, the predetermined maximum digital voltage Vmax and the predetermined minimum digital voltage Vmin may be selected according to actual situations; for example, when the input voltage range of the analog-to-digital converter ADC is 0V-5V, Vmax may be set to a digital voltage corresponding to 4.8V (that is, Vmax is equal to the digital voltage output by the ADC when the input terminal of the ADC receives a voltage of 4.8V). The voltage Vmin is set to a digital voltage corresponding to 0.5V (that is, Vmax is equal to the digital voltage output by the ADC when the input terminal of the ADC receives a voltage of 0.5V), but not limited to this.

In practice, the predetermined maximum digital voltage Vmax may be a digital voltage corresponding to an analog voltage slightly smaller than an upper limit of the input voltage range of the digital-to-analog converter ADC.

Figure 4:
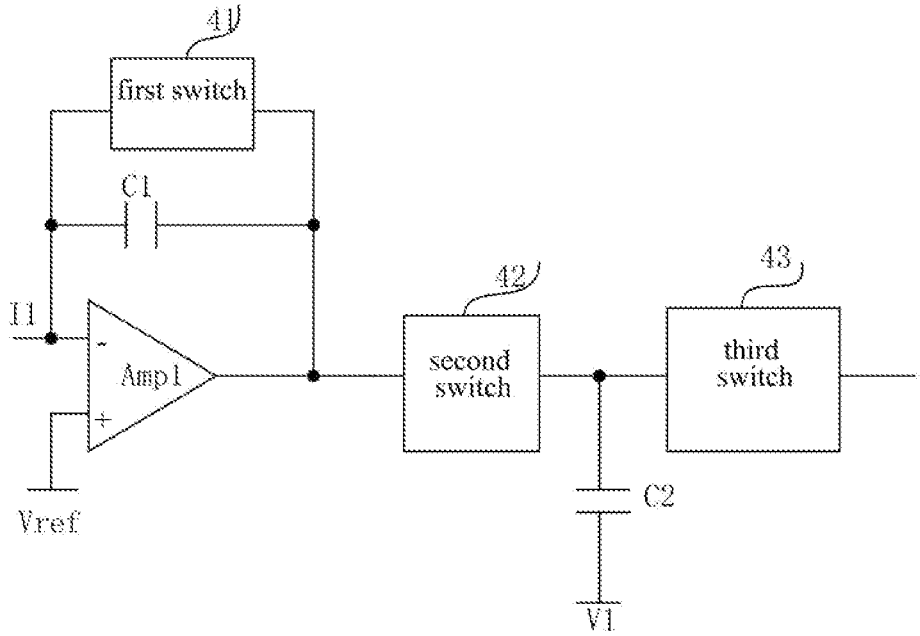
FIG. 4 is a circuit diagram of a first conversion sub-circuit included in the pixel current detection circuit according to an embodiment of the present disclosure.

Optionally, as shown in FIG. 4, the first conversion sub-circuit may include a first differential operational amplifier Amp1, a first storage capacitor C1, a second storage capacitor C2, a first switch 41, a second switch 42, and a third switch 43; the detection sub-circuit further includes a first initialization circuit (not shown in FIG. 4);

an inverting input terminal of the first differential operational amplifier Amp1 is connected to the first pixel current output terminal (not shown in FIG. 4) included in the pixel current conversion circuit, a non-inverting input terminal of the first differential operational amplifier Amp1 is connected to a reference voltage input terminal; the reference voltage input terminal is used to input a reference voltage Vref;

the first switch 41 and the first storage capacitor C1 are connected in parallel between the inverting input terminal of the first differential operational amplifier Amp1 and an output terminal of the first differential operational amplifier Amp1;

the output terminal of the first differential operational amplifier Amp1 is connected to a first terminal of the second switch 42, a second terminal of the second switch 42 is connected to a first terminal of the third switch 43, a second terminal of the third switch 43 is connected to the analog-to-digital converter (not shown in FIG. 4) included in the detection sub-circuit;

a first terminal of the second storage capacitor C2 is connected to the second terminal of the second switch 42, a second terminal of the second storage capacitor C2 is connected to a first voltage input terminal; the first voltage input terminal is used to input a first voltage V1;

the first initialization circuit (not shown in FIG. 4) is configured to provide the reference voltage Vref to the inverting input terminal of the first differential operational amplifier Amp1 and/or the output terminal of the first differential operational amplifier Amp1 in an initial stage;

the first switch 41 is configured to turn on or turn off a connection between the inverting input terminal of the first differential operational amplifier Amp1 and the output terminal of the first differential operational amplifier Amp1;

the second switch 42 is configured to turn on or turn off a connection between the output terminal of the first differential operational amplifier Amp1 and the first terminal of the second storage capacitor C2;

the third switch 43 is configured to turn on or turn off a connection between the first terminal of the second storage capacitor C2 and the analog-to-digital converter (not shown in FIG. 4).

In practice, the first switch 41 is configured to turn on, in the initial stage, the connection between the inverting input terminal of the first differential operational amplifier Amp1 and the output terminal of the first differential operational amplifier Amp1, and to turn off, in an integration stage and the sampling stage, the connection between the inverting input terminal of the first differential operational amplifier Amp1 and the output terminal of the first differential operational amplifier Amp1;

the second switch 42 is configured to turn on, in the initial stage and the integration stage, the connection between the output terminal of the first differential operational amplifier Amp1 and the first terminal of the second storage capacitor C2, and to turn off, in the sampling stage, the connection between the output terminal of the first differential operational amplifier Amp1 and the first terminal of the second storage capacitor C2;

the third switch 43 is configured to turn off, in the initial stage, the integration stage and a period included in the sampling stage except for the first sampling period, the connection between the first terminal of the second storage capacitor C2 and the analog-to-digital converter (not shown in FIG. 4), and to turn on, in the first sampling period, the connection between the first terminal of the second storage capacitor C2 and the analog-to-digital converter (not shown in FIG. 4).

In practice, the first switch 41 may include a first switch element, the second switch 42 may include a second switch element, and the third switch 43 may include a third switch element.

In the embodiment shown in FIG. 4, the first voltage input terminal may be a ground terminal or a low voltage input terminal, but is not limited thereto.

Figure 5:
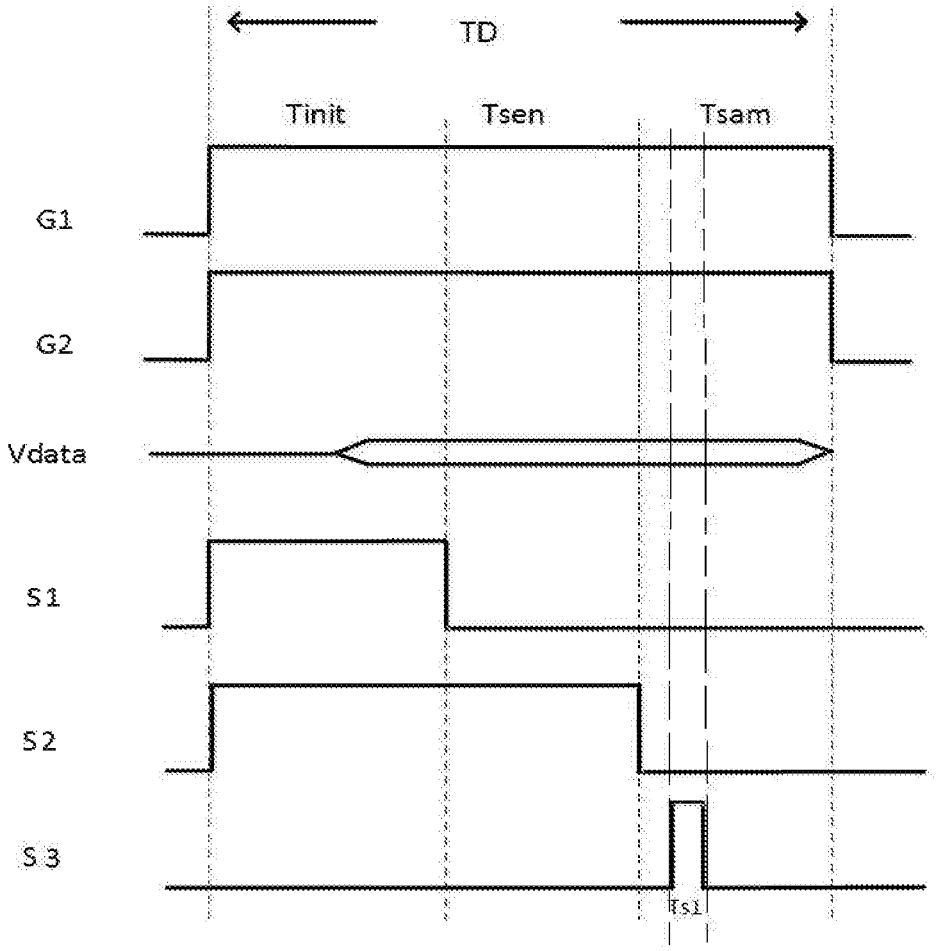
FIG. 5 is an operation timing diagram of the first conversion sub-circuit shown in FIG. 4 according to an embodiment of the present disclosure.

As shown in FIG. 5, when the embodiment of the first conversion sub-circuit of the present disclosure shown in FIG. 4 is in operation, a detection time TD includes an initial stage Tinit, an integration stage Tsen, and a sampling stage Tsam arranged in sequence; the sampling stage Tsam includes a first sampling period Ts1;

in the initial stage Tinit, S1 is at a high level, S2 is at a high level, and S3 is at a low level. The first switch 41 turns on the connection between the inverting input terminal of the first differential operational amplifier Amp1 and the output terminal of the first differential operational amplifier Amp, the second switch 42 turns on the connection between the output terminal of the first differential operational amplifier Amp1 and the first terminal of the second storage capacitor C2; the third switch 43 turns off the connection between the first terminal of the second storage capacitor C2 and the analog-to-digital converter (not shown in FIG. 4); the first initialization circuit (not shown in FIG. 4)) provides the reference voltage Vref to the inverting input terminal of the first differential operational amplifier Amp1 and/or an output terminal of the first differential operational amplifier Amp1, so that the inverting input terminal of the first differential operational amplifier Amp1 and the output terminal of the first differential operational amplifier Amp1 are connected to Vref, thereby eliminating the influence of previous data on the detection result;

in the integration stage Tsen, S is at a low level, S2 is at a high level, and S3 is at a low level. The first switch 41 turns off the connection between the inverting input terminal of the first differential operational amplifier Amp1 and the output terminal of the first differential operational amplifier Amp1, and the second switch 42 turns on the connection between the output terminal of the first differential operational amplifier Amp1 and the first terminal of the second storage capacitor C2, the third switch 43 turns off the connection between the first terminal of the second storage capacitor C2 and the analog-to-digital converter (not shown in FIG. 4), charging the first storage capacitor C1 by the first pixel current I1;

in the sampling stage Tsam, S1 and S2 are at a low level, and the first switch 41 turns off the connection between the inverting input terminal of the first differential operational amplifier Amp1 and the output terminal of the first differential operational amplifier Amp1, the second switch 42 turns off the connection between the output terminal of the first differential operational amplifier Amp1 and the first terminal of the second storage capacitor C2;

during the first sampling period Ts1, S3 is at a high level, the third switch 43 turns on the connection between the first terminal of the second storage capacitor C2 and the analog-to-digital converter (not shown in FIG. 4). The analog-to-digital converter samples the voltage at the first terminal of the second storage capacitor C2, which is the first detection voltage VD1;

in a period included in the sampling stage Tsam except for the first sampling period Ts1, S3 is at a low level, and the third switch 43 turns off the connection between the first terminal of the second storage capacitor C2 and the analog-to-digital converter (not shown in FIG. 4).

In FIG. 5, the reference sign S represents a first control signal for controlling the first switch 41 to be turned on or off, the reference sign S2 represents a second control signal for controlling the second switch 42 to be turned on or off, and the reference sign S3 represents a third control signal for controlling the third switch 43 to be turned on or off. In the embodiment shown in FIG. 4, when S1 is at a high level, the first switch 41 is turned on, and when S1 is at a low level, the first switch 41 is turned off; when S2 is at a high level, the second switch 42 is turned on, and when S2 is at a low level, the second switch 42 is turned off; when S3 is at a high level, the third switch 43 is turned on, and when S3 is at a low level, the third switch 43 is turned off.

Figure 6:
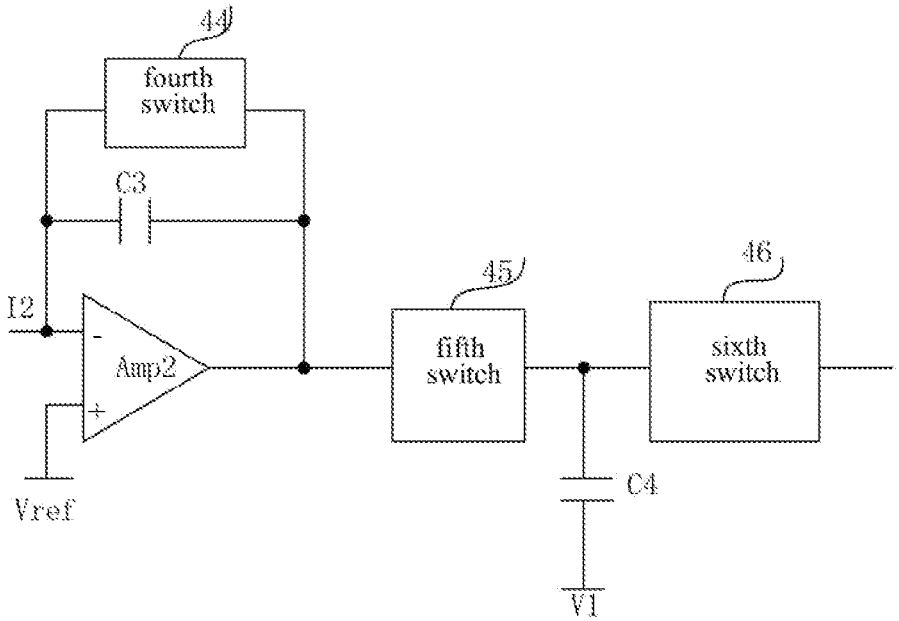
FIG. 6 is a circuit diagram of a second conversion sub-circuit included in the pixel current detection circuit according to an embodiment of the present disclosure.

Optionally, as shown in FIG. 6, the second conversion sub-circuit may include a second differential operational amplifier Amp2, a third storage capacitor C3, a fourth storage capacitor C4, a fourth switch 44, a fifth switch 45, and a sixth switch 46; the detection sub-circuit further includes a second initialization circuit (not shown in FIG. 6);

the inverting input terminal of the second differential operational amplifier Amp2 is connected to a second pixel current output terminal (not shown in FIG. 6) included in the pixel current conversion circuit (that is, the inverting input terminal of Amp2 receives the second pixel current I2), the non-inverting input terminal of the second differential operational amplifier Amp2 is connected to a reference voltage input terminal; the reference voltage input terminal is used to input a reference voltage Vref;

the fourth switch 44 and the third storage capacitor C3 are connected in parallel between the inverting input terminal of the second differential operational amplifier Amp2 and the output terminal of the second differential operational amplifier Amp2;

the output terminal of the second differential operational amplifier Amp2 is connected to a first terminal of the fifth switch 45, and a second terminal of the fifth switch 45 is connected to a first terminal of the sixth switch 46, a second terminal of the sixth switch 46 is connected to the analog-to-digital converter (not shown in FIG. 6);

a first terminal of the fourth storage capacitor C4 is connected to a second terminal of the fifth switch 45, and a second terminal of the fourth storage capacitor C4 is connected to a first voltage input terminal; the first voltage input terminal is used to input the first voltage V1;

the second initialization circuit (not shown in FIG. 6) is configured to provide the reference voltage to the inverting input terminal of the second differential operational amplifier and/or the output terminal of the second differential operational amplifier in an initial stage;

the fourth switch 44 is configured to turn on or turn off a connection between the inverting input terminal of the second differential operational amplifier Amp2 and the output terminal of the second differential operational amplifier Amp2;

the fifth switch 45 is configured to turn on or turn off a connection between the output terminal of the second differential operational amplifier Amp2 and the first terminal of the fourth storage capacitor C4;

the sixth switch 46 is configured to turn on or turn off a connection between the first terminal of the fourth storage capacitor C4 and the analog-to-digital converter (not shown in FIG. 6).

In the embodiment shown in FIG. 6, the first voltage input terminal may be a ground terminal or a low voltage input terminal, but is not limited thereto.

In practice, the fourth switch 44 may include a fourth switch element, the fifth switch 45 may include a fifth switch element, and the sixth switch 46 may include a sixth switch element.

In practice, the fourth switch 44 is configured to turn on, in the initial stage, the connection between the inverting input terminal of the second differential operational amplifier Amp2 and the output terminal of the second differential operational amplifier Amp2, and to turn off, in the integration stage and the sampling stage, the connection between the inverting input terminal of the second differential operational amplifier Amp2 and the output terminal of the second differential operational amplifier Amp2;

the fifth switch 45 is configured to turn on, in the initial stage and the integration stage, the connection between the output terminal of the second differential operational amplifier Amp2 and the first terminal of the fourth storage capacitor C4, and to turn off, in the sampling stage, the connection between the output terminal of the second differential operational amplifier Amp2 and the first terminal of the fourth storage capacitor C4;

the sixth switch 46 is configured to turn off, in the initial stage, the integration stage and a period included in the sampling stage except for the second sampling period, the connection between the first terminal of the fourth storage capacitor C4 and the analog-to-digital converter (not shown in FIG. 6), and to turn on, in the second sampling period, the connection between the first terminal of the fourth storage capacitor C4 and the analog-to-digital converter.

When the second conversion sub-circuit 22 of the present disclosure shown in FIG. 6 is in operation, a detection time includes an initial stage, an integration stage, and a sampling stage arranged in sequence; the sampling stage further includes a second sampling period;

in the initial stage, the fourth switch 44 turns on the connection between the inverting input terminal of the second differential operational amplifier Amp2 and the output terminal of the second differential operational amplifier Amp2, the fifth switch 45 turns on the connection between the output terminal of the second differential operational amplifier Amp2 and the first terminal of the fourth storage capacitor C4; the sixth switch 46 turns off the connection between the first terminal of the fourth storage capacitor C4 and the analog-to-digital converter (not shown in FIG. 6); the second initialization circuit (not shown in FIG. 6) provides the reference voltage Vref to the inverting input terminal of the second differential operational amplifier Amp2 and/or the output terminal of the second differential operational amplifier Amp2, so that the inverting input terminal of Amp2 and the output terminal of Amp2 are connected to Vref, thereby eliminating the influence of the previous data on the detection result;

in the integration stage, the fourth switch 44 turns off the connection between the inverting input terminal of the second differential operational amplifier Amp2 and the output terminal of the second differential operational amplifier Amp2, the fifth switch 45 turns on the connection between the output terminal of the second differential operational amplifier Amp2 and the first terminal of the fourth storage capacitor C4, and the sixth switch 46 turns off the connection between the first terminal of the fourth storage capacitor C4 and the analog-to-digital converter (not shown in FIG. 6), charging the third storage capacitor C3 by the second pixel current I2;

in the sampling stage, the fourth switch 44 turns off the connection between the inverting input terminal of the second differential operational amplifier Amp2 and the output terminal of the second differential operational amplifier Amp2, the fifth switch 45 turns off the connection between the output terminal of the second differential operational amplifier Amp2 and the first terminal of the fourth storage capacitor C4;

in the second sampling period, the sixth switch 46 turns on the connection between the first terminal of the fourth storage capacitor C4 and the analog-to-digital converter (not shown in FIG. 6), and the analog-to-digital converter samples a voltage at the first terminal of the fourth storage capacitor C4, which is the second detection voltage VD2;

in a period included in the sampling stage except for the second sampling period, the sixth switch 46 turns off the connection between the first terminal of the fourth storage capacitor C4 and the analog-to-digital converter (not shown in FIG. 6).

Figure 7:
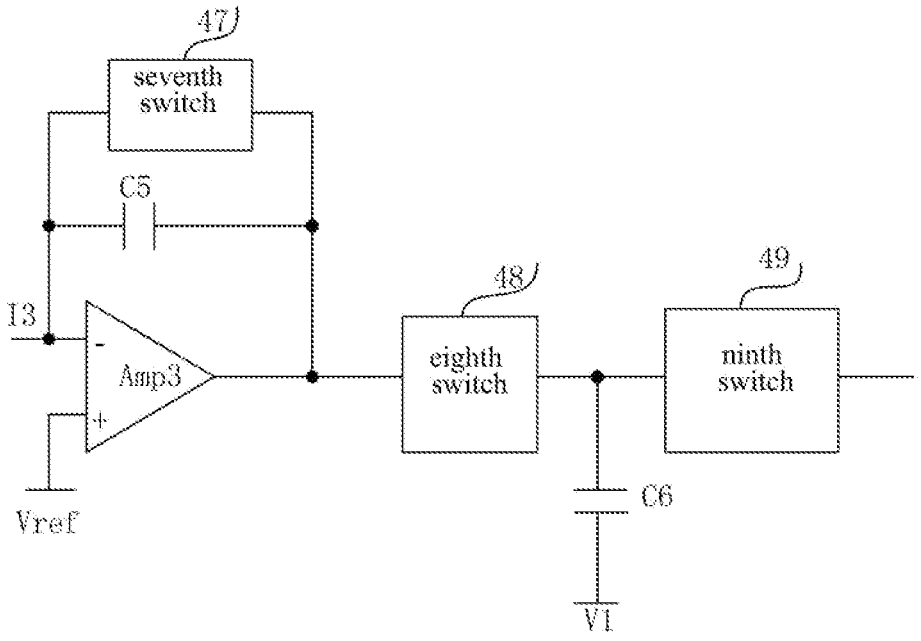
FIG. 7 is a circuit diagram of a third conversion sub-circuit included in the pixel current detection circuit according to an embodiment of the present disclosure.

Optionally, as shown in FIG. 7, the third conversion sub-circuit may include a third differential operational amplifier Amp3, a fifth storage capacitor C5, a sixth storage capacitor C6, a seventh switch 47, an eighth switch 48, and a ninth switch 49; the detection sub-circuit further includes a third initialization circuit (not shown in FIG. 7);

an inverting input terminal of the third differential operational amplifier Amp3 is connected to a third pixel current output terminal (not shown in FIG. 7) included in the pixel current conversion circuit (that is, the inverting input terminal of Amp3 receives the third pixel current I3), a non-inverting input terminal of the third differential operational amplifier Amp3 is connected to a reference voltage input terminal; the reference voltage input terminal is used to input a reference voltage Vref;

the seventh switch 47 and the fifth storage capacitor C5 connected in parallel with each other are connected between the inverting input terminal of the third differential operational amplifier Amp3 and an output terminal of the third differential operational amplifier Amp3;

the output terminal of the third differential operational amplifier Amp3 is connected to a first terminal of the eighth switch 48, a second terminal of the eighth switch 48 is connected to a first terminal of the ninth switch 49, a second terminal of the ninth switch 49 is connected to the analog-to-digital converter (not shown in FIG. 7);

a first terminal of the sixth storage capacitor C6 is connected to the second terminal of the eighth switch 48, a second terminal of the sixth storage capacitor C6 is connected to a first voltage input terminal; the first voltage input terminal is used to input the first voltage V1;

the third initialization circuit (not shown in FIG. 7) is configured to provide the reference voltage Vref to the inverting input terminal of the third differential operational amplifier Amp3 and/or the output terminal of the third differential operational amplifier in an initial stage Amp3;

the seventh switch 47 is configured to turn on or turn off a connection between the inverting input terminal of the third differential operational amplifier Amp3 and the output terminal of the third differential operational amplifier Amp3;

the eighth switch 48 is configured to turn on or turn off a connection between the output terminal of the third differential operational amplifier Amp3 and the first terminal of the sixth storage capacitor C6;

the ninth switch 49 is configured to turn on or turn off a connection between the first terminal of the sixth storage capacitor C6 and the analog-to-digital converter (not shown in FIG. 7).

In practice, the seventh switch 47 is configured to turn on, in the initial stage, the connection between the inverting input terminal of the third differential operational amplifier Amp3 and the output terminal of the third differential operational amplifier Amp3, and to turn off, in an integration stage and the sampling stage, the connection between the inverting input terminal of the third differential operational amplifier Amp3 and the output terminal of the third differential operational amplifier Amp3;

the eighth switch 48 is configured to turn on, in the initial stage and the integration stage, the connection between the output terminal of the third differential operational amplifier Amp3 and the first terminal of the sixth storage capacitor C6, and to turn off the connection between the output terminal of the third differential operational amplifier Amp3 and the first terminal of the sixth storage capacitor C6 in the sampling stage;

the ninth switch 49 is configured to turn off, in the initial stage, the integration stage and a period included in the sampling stage except for the third sampling period, the connection between the first terminal of the sixth storage capacitor C6 and the analog-to-digital converter (not shown in FIG. 7), and to turn on the connection between the first terminal of the sixth storage capacitor C6 and the analog-to-digital converter in the third sampling period.

In the embodiment shown in FIG. 7, the first voltage input terminal may be a ground terminal or a low voltage input terminal, but is not limited thereto.

In practice, the seventh switch 47 may include a seventh switch element, the eighth switch 48 may include an eighth switch element, and the ninth switch 49 may include a ninth switch element.

When the third conversion sub-circuit 23 of the present disclosure shown in FIG. 7 is in operation, a detection time includes an initial stage, an integration stage, and a sampling stage arranged in sequence; the sampling stage further includes a third sampling period;

in the initial stage, the seventh switch 47 turns on the connection between the inverting input terminal of the third differential operational amplifier Amp3 and the output terminal of the third differential operational amplifier Amp3, the eighth switch 48 turns on the connection between the output terminal of the third differential operational amplifier Amp3 and the first terminal of the sixth storage capacitor C6; the ninth switch 49 turns off the connection between the first terminal of the sixth storage capacitor C6 and the analog-to-digital converter (not shown in FIG. 7); the third initialization circuit (not shown in FIG. 7) provides the reference voltage Vref to the inverting input terminal of the third differential operational amplifier Amp3 and/or the output terminal of the third differential operational amplifier Amp3, so that the inverting input terminal of Amp3 and the output terminal of Amp3 are connected to Vref, thereby eliminating the influence of the previous data on the detection result;

in the integration stage, the seventh switch 47 turns off the connection between the inverting input terminal of the third differential operational amplifier Amp3 and the output terminal of the third differential operational amplifier Amp3, the eighth switch 48 turns on the connection between the output terminal of the third differential operational amplifier Amp3 and the first terminal of the sixth storage capacitor C6, and the ninth switch 49 turns off the connection between the first terminal of the sixth storage capacitor C6 and the analog-to-digital converter (not shown in FIG. 7), charging the fifth storage capacitor C5 with the third pixel current I3;

in the sampling stage, the seventh switch 47 turns off the connection between the inverting input terminal of the third differential operational amplifier Amp3 and the output terminal of the third differential operational amplifier Amp3, and the eighth switch 48 turns off the connection between the output terminal of the third differential operational amplifier Amp3 and the first terminal of the sixth storage capacitor C6;

in the third sampling period, the ninth switch 49 turns on the connection between the first terminal of the sixth storage capacitor C6 and the analog-to-digital converter (not shown in FIG. 7), and the analog-to-digital converter samples a voltage at the first terminal of the sixth storage capacitor C6, which is the third detection voltage VD3;

in a period included in the sampling stage except for the third sampling period, the ninth switch 49 turns off the connection between the first terminal of the sixth storage capacitor C6 and the analog-to-digital converter (not shown in FIG. 7).

Optionally, the pixel current conversion circuit may include:

an input transistor having a gate and a first electrode connected to the pixel current, and a second electrode connected to a second voltage input terminal;

a first power-supply transistor having a gate and a first electrode connected to a third voltage input terminal;

a first output transistor having a gate connected to the gate of the input transistor, a first electrode connected to a second electrode of the first power-supply transistor, and a second electrode for outputting the first pixel current;

a second power-supply transistor having a gate and a first electrode both connected to the third voltage input terminal;

a second output transistor having a gate connected to the gate of the input transistor, a first electrode connected to a second electrode of the second power-supply transistor, and a second electrode for outputting the second pixel current;

a third power-supply transistor having a gate and a first electrode both connected to the third voltage input terminal;

a third output transistor having a gate connected to the gate of the input transistor, a first electrode connected to a second electrode of the third power-supply transistor, and a second electrode for outputting the third pixel current;

a ratio of a width-to-length ratio of the first output transistor to a width-to-length ratio of the input transistor is less than 1, and a ratio of a width-to-length ratio of the third output transistor to the width-to-length ratio of the input transistor is greater than 1.

In practice, the second voltage input terminal may be a ground terminal or a low voltage input terminal, but is not limited thereto.

In practice, the third voltage input terminal may be a high voltage input terminal, but is not limited thereto.

Optionally, the ratio of the width-to-length ratio of the first output transistor to the width-to-length ratio of the input transistor may be greater than 0 and less than 0.6, and the ratio of the width-to-length ratio of the third output transistor to the width-to-length ratio of the input transistor may be greater than 1.5.

Figure 8:
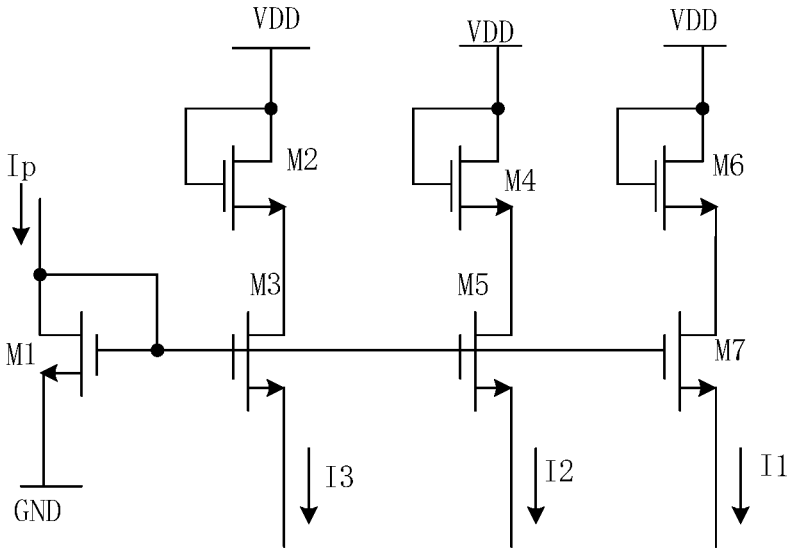
FIG. 8 is a circuit diagram of a pixel current conversion circuit included in the pixel current detection circuit according to an embodiment of the present disclosure.

As shown in FIG. 8, an embodiment of the pixel current conversion circuit includes:

an input transistor M1 having a gate and a drain connected to the pixel current Ip, and a source connected to a ground terminal GND;

a first power-supply transistor M6 having a gate and a drain connected to a high voltage input terminal; the high voltage input terminal is used to input a high voltage VDD;

a first output transistor M7 having a gate connected to the gate of the input transistor M1, a drain connected to a source of the first power-supply transistor M6, and a source for outputting the first pixel current I1;

a second power-supply transistor M4 having a gate and a drain connected to the high voltage VDD;

a second output transistor M5 having a gate connected to the gate of the input transistor M1, a drain connected to a source of the second power-supply transistor M4, and a source for outputting the second pixel current I2;

a third power-supply transistor M2 having a gate and a drain connected to the high voltage VDD;

a third output transistor M3 having a gate connected to the gate of the input transistor M1, a drain connected to a source of the third power-supply transistor M2, and a source for outputting the third pixel current 3.

In the embodiment of the pixel current conversion circuit shown in FIG. 8, all the transistors are N-type transistors, but not limited thereto.

In the embodiment shown in FIG. 8, I1 is equal to Ip/2, I2 is equal to Ip, I3 is equal to 2Ip, the width-length ratio of M7 is half of the width-length ratio of M1, the width-length ratio of M5 is equal to that of M1, and the width-to-length ratio of M3 is twice of M1.

The pixel current detection circuit according to the present disclosure will described below with reference to an embodiment.

Figure 9:
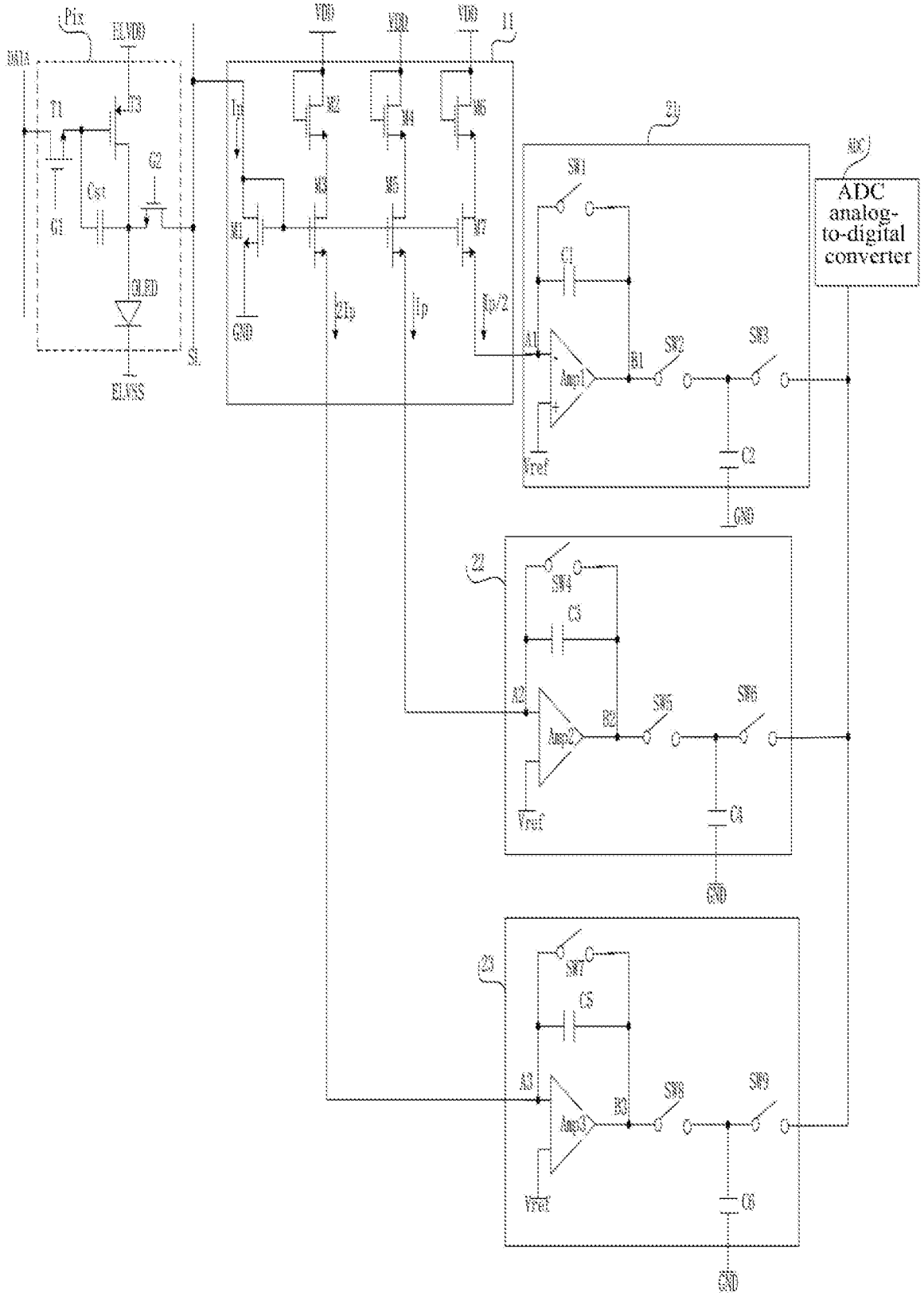
FIG. 9 is a circuit diagram of a pixel current detection circuit according to an embodiment of the present disclosure.

An embodiment of the pixel current detection circuit according to the present disclosure is applied to a pixel circuit to detect a pixel current Ip in the pixel circuit. As shown in FIG. 9, the embodiment of the pixel current detection circuit according to the present disclosure including a pixel current conversion circuit I1 and a current detection circuit;

the pixel current conversion circuit I1 includes:

an input transistor M1 having a gate and a drain connected to the pixel current Ip, and a source connected to a ground terminal GND;

a first power-supply transistor M6 having a gate and a drain both connected to a high voltage input terminal; the high voltage input terminal is used to input a high voltage VDD;

a first output transistor M7 having a gate connected to the gate of the input transistor M1, a drain connected to a source of the first power-supply transistor M6, and a source for outputting the first pixel current I1;

a second power-supply transistor M4 having a gate and a drain connected to the high voltage VDD;

a second output transistor M5 having a gate connected to the gate of the input transistor M1, a drain connected to a source of the second power-supply transistor M4, and a source for outputting the second pixel current I2;

a third power-supply transistor M2 having a gate and a drain connected to the high voltage VDD;

a third output transistor M3 having a gate connected to the gate of the input transistor M1, a drain connected to a source of the third power-supply transistor M2, and a source for outputting the third pixel current I3;

The source of the first output transistor M7 is the first pixel current output terminal of the pixel current conversion circuit I1, the source of the second output transistor M5 is the second pixel current output terminal of the pixel current conversion circuit I1, the source of the third output transistor current M3 is the third pixel current output terminal of the pixel current conversion circuit I1;

The current detection circuit includes the first conversion sub-circuit 21, the second conversion sub-circuit 22, the third conversion sub-circuit 23, and a detection sub-circuit;

The detection sub-circuit includes an analog-to-digital converter ADC, a comparator (not shown in FIG. 9) and a pixel current acquisition circuit (not shown in FIG. 9);

the first conversion sub-circuit 21 includes a first differential operational amplifier Amp1, a first storage capacitor C1, a second storage capacitor C2, a first switch element SW1, a second switch element SW2, and a third switch element SW3; the detector sub-circuit further includes a first initialization circuit (not shown in FIG. 9);

an inverting input terminal of the first differential operational amplifier Amp1 is connected to a source of the first output transistor M7, and a non-inverting input terminal of the first differential operational amplifier Amp1 receives a reference voltage Vref;

the first switch element SW1 and the first storage capacitor C1 are connected in parallel between the inverting input terminal of the first differential operational amplifier Amp1 and the output terminal of the first differential operational amplifier Amp1;

the output terminal of the first differential operational amplifier Amp1 is connected to a first terminal of the second switch element SW2, and a second terminal of the second switch element SW2 is connected to a first terminal of the third switch element SW3, and a second terminal of the third switch element SW3 is connected to an input terminal of the analog-to-digital converter ADC;

a first terminal of the second storage capacitor C2 is connected to the second terminal of the second switch element SW2, and a second terminal of the second storage capacitor C2 is connected to a ground terminal GND;

the first initialization circuit (not shown in FIG. 9) is configured to provide the reference voltage Vref to the output terminal of the first differential operational amplifier Amp1 in an initial stage;

the second conversion sub-circuit 22 includes a second differential operational amplifier Amp2, a third storage capacitor C3, a fourth storage capacitor C4, a fourth switch element SW4, a fifth switch element SW5, and a sixth switch element SW6; the detector sub-circuit further includes a second initialization circuit (not shown in FIG. 9);

an inverting input terminal of the second differential operational amplifier Amp2 is connected to a source of the second output transistor M5, and a non-inverting input terminal of the second differential operational amplifier Amp2 receives the reference voltage Vref;

the fourth switch element SW4 and the third storage capacitor C3 connected in parallel with each other are connected between the inverting input terminal of the second differential operational amplifier Amp2 and an output terminal of the second differential operational amplifier Amp2;

the output terminal of the second differential operational amplifier Amp2 is connected to a first terminal of the fifth switch element SW5, and a second terminal of the fifth switch element SW5 is connected to a first terminal of the sixth switch element SW6, and a second terminal of the sixth switch element SW6 is connected to the input terminal of the analog-to-digital converter ADC;

a first terminal of the fourth storage capacitor C4 is connected to the second terminal of the fifth switch element SW5, and a second terminal of the fourth storage capacitor C4 is connected to the ground terminal GND;

the second initialization circuit (not shown in FIG. 9) is configured to provide the reference voltage Vref to the output terminal of the second differential operational amplifier Amp2 in the initial stage;

the third conversion sub-circuit includes a third differential operational amplifier Amp3, a fifth storage capacitor C5, a sixth storage capacitor C6, a seventh switch element SW7, an eighth switch element SW8, and a ninth switch element SW9; the detection sub-circuit further includes a third initialization circuit (not shown in FIG. 9);

an inverting input terminal of the third differential operational amplifier Amp3 is connected to the source of the third output transistor M3, and a non-inverting input terminal of the third differential operational amplifier Amp3 receives the reference voltage Vref;

the seventh switch element SW7 and the fifth storage capacitor C5 are connected in parallel between the inverting input terminal of the third differential operational amplifier Amp3 and an output terminal of the third differential operational amplifier Amp3;

the output terminal of the third differential operational amplifier Amp3 is connected to a first terminal of the eighth switch element SW8, a second terminal of the eighth switch element SW8 is connected to a first terminal of the ninth switch element SW9, and a second terminal of the ninth switch element SW9 is connected to the input terminal of the analog-to-digital converter ADC;

a first terminal of the sixth storage capacitor C6 is connected to the second terminal of the eighth switch element SW8, and a second terminal of the sixth storage capacitor C6 is connected to the ground terminal GND;

the third initialization circuit (not shown in FIG. 9) is configured to provide the reference voltage Vref to the output terminal of the third differential operational amplifier Amp3 in the initial stage;

In the embodiment shown in FIG. 9, I1 is equal to Ip/2, I2 is equal to Ip, I3 is equal to 2Ip, the width-length ratio of M7 is half of the width-length ratio of M1, the width-length ratio of M5 is equal to that of M1, and the width-to-length ratio of M3 is twice of M1.

In the embodiment shown in FIG. 9, the reference voltage Vref is a ground voltage, that is, the non-inverting input terminal of Amp1, the non-inverting input terminal of Amp2, and the non-inverting input terminal of Amp3 are all grounded. According to the virtual-short characteristic of the operational amplifier (i.e., it is equivalent to a short circuit between the non-inverting input terminal of the operational amplifier and the inverting input terminal of the operational amplifier, and the voltage at the non-inverting input terminal of the operational amplifier is equal to the voltage at the inverting input terminal of the operational amplifier), the source of M3, the source of M5 and the source of M7 are all grounded. Since the source of M1 is connected to the ground terminal GND, and the gates of M1, M3, M5, and M7 are connected to each other, a current mirror is formed by M1, M3, M5, and M7. It should be noted that the sources of M1, M3, M5, and M7 may also be not grounded, as long as their potentials are equal.

In the embodiment shown in FIG. 9, M1, M3, M5, and M7 form a current mirror. The ratio of I3 flowing through M3 to Ip flowing through M1 is the ratio of the width-length ratio of M3 to the width-length ratio of M1. The ratio of I2 flowing through M5 to Ip flowing through M1 is the ratio of the width-length ratio of M5 to the width-length ratio of M1. The ratio of I1 flowing through M7 to Ip flowing through M1 is the ratio of the width-length ratio of M7 to the width-length ratio of M1.

In FIG. 9, the point A1 is a node connected with the inverting input terminal of Amp1, the point B1 is a node connected with the output terminal of Amp1, the point A2 is a node connected with the inverting input terminal of Amp2, the point B2 is a node connected with the output terminal of Amp2, the point A3 is a node connected with the inverting input terminal of Amp3, and the point B3 is a node connected with the output terminal of Amp3.

Moreover, in the embodiment shown in FIG. 9, Ip is taken from an external compensation line SL, and the gate and drain of the input transistor M1 are both connected to the external compensation line SL;

The pixel circuit Pix, to which the pixel current detection circuit according to the present disclosure shown in FIG. 9 is applied, includes a data writing transistor T1, a display storage capacitor Cst, a driving transistor T3, and a compensation output transistor T2. A gate of T1 is connected to a first scanning line G1, a gate of T2 is connected to a second scanning line G2, a drain of T1 is connected to a data line DATA, a source of T1 is connected to a gate of T3, a first terminal of Cst is connected to the gate of T3, a second terminal of Cst is connected to a source of T3, a drain of T3 receives a positive power supply voltage ELVDD, the source of T3 is connected to a anode of an organic light emitting diode OLED, a cathode of OLED receives a negative power supply voltage ELVSS, a source of T2 is connected to the anode of OLED, and a drain of T2 is connected to the external compensation line SL.

In the embodiment shown in FIG. 9, all the transistors are N-type transistors, but not limited thereto.

Figure 10:
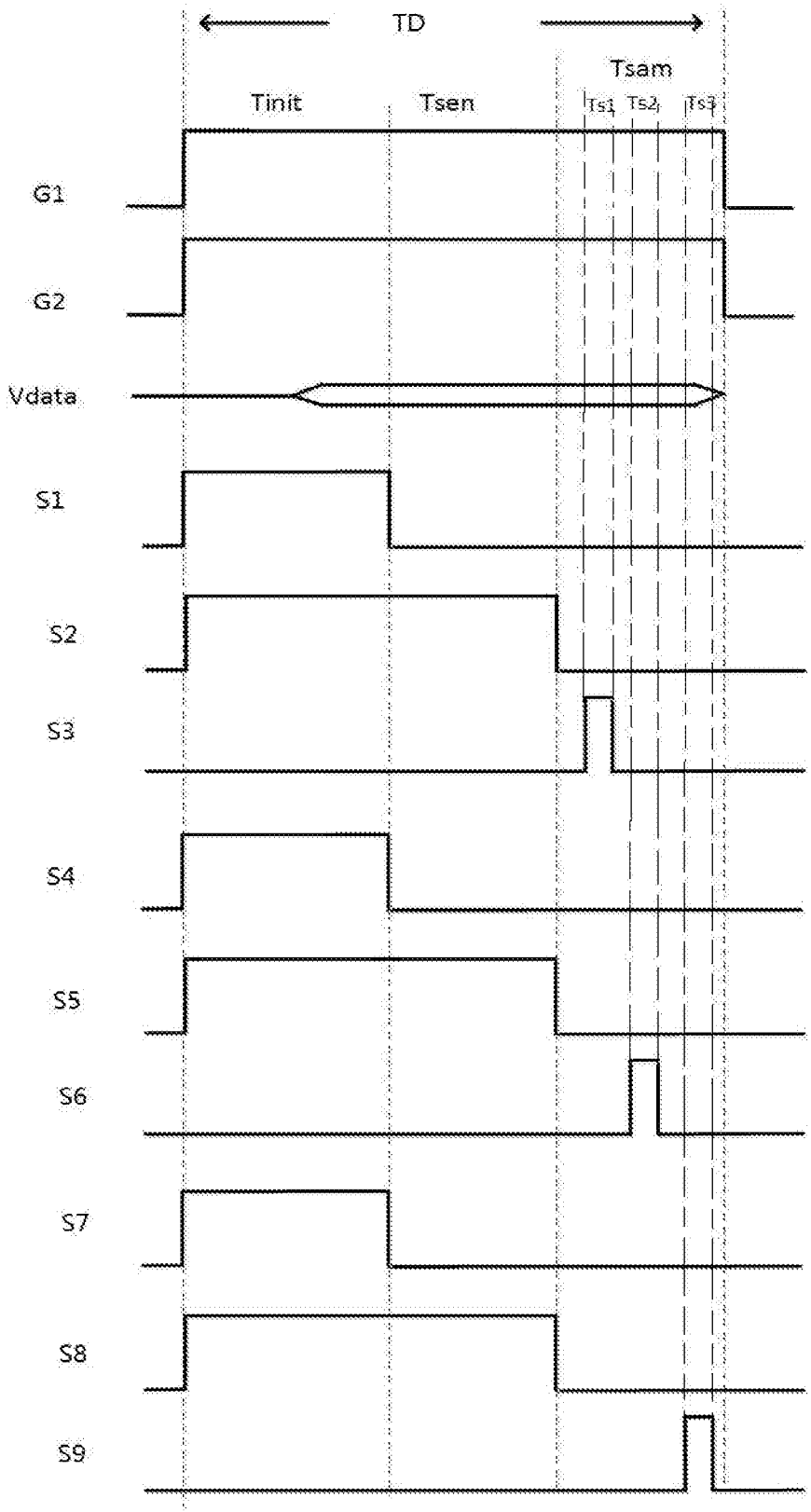
FIG. 10 is an operation timing diagram of the pixel current detection circuit shown in FIG. 9 according to an embodiment of the present disclosure.

FIG. 10 is an operation timing diagram of the pixel current detection circuit shown in FIG. 9.

In FIG. 10, the reference sign S1 represents a first control signal for controlling the first switch element SW to be turned on or off, the reference sign S2 represents a second control signal to control the second switch element SW2 to be turned on or off, and the reference sign S3 represents a third control signal for controlling the third switch element SW3 to be turned on or off; the reference sign S4 represents a fourth control signal for controlling the fourth switch element SW4 to be turned on or off, the reference sign S5 represents a fifth control signal for controlling the fifth switch element SW5 to be turned on or off, the reference sign S6 represents a sixth control signal for controlling the sixth switch element SW6 to be turned on or off; the reference sign S7 represents a seventh control signal for controlling the seventh switch element SW7 to be turned on or off, the reference sign S8 represents an eighth control signal for controlling the eighth switch element SW8 to be turned on or off, and the reference sign S9 represents a ninth control signal for controlling the ninth switch element SW9 to be turned on or off. In the embodiment shown in FIG. 9, when S is at a high level, SW1 is turned on, and when S1 is at a low level, SW1 is turned off; when S2 is at a high level, SW2 is turned on, and when S2 is at a low level, SW2 is turned off; when S3 is at a high level, SW3 is turned on, and when S3 is at a low level, SW3 is turned off; when S4 is at a high level, SW4 is turned on, and when S4 is at a low level, SW4 is turned off; when S5 is at a high level, SW5 is turned on, and when S5 is at a low level, SW5 is turned off; when S6 is at a high level, SW6 is turned on, and when S6 is at a low level, SW6 is turned off; when S7 is at a high level, SW7 is turned on, and when S7 is at a low level, SW7 is turned off; when S8 is at a high level, SW8 is turned on, and when S8 is at a low level, SW8 is turned off; when S9 is at a high level, SW9 is turned on, and when S9 is at a low level, SW9 is turned off.

As shown in FIG. 10, when the embodiment of the pixel current detection circuit according to the present disclosure shown in FIG. 9 is in operation, a detection time TD includes an initial stage Tinit, an integration stage Tsen, and a sampling stage Tsam arranged in sequence;

In the initial stage Tinit, both G1 and G2 output a high level, both T1 and T2 are turned on, a reset potential (the reset potential can be zero potential, but not limited to this) is written to DATA and SL, then DATA is controlled to output a data voltage Vdata, and the reference voltage Vref is written to SL. At this time, the first initialization circuit (not shown in FIG. 9) provides the reference voltage Vref to the output terminal of Amp1, the second initialization circuit (not shown in FIG. 9)) provide Vref to the output terminal of Amp2, and the third initialization circuit (not shown in FIG. 9) provides Vref to the output terminal of Amp3; S, S2, S4, S5, S7, and S8 are at a high level, S3, S6, and S9 are at a low level, SW1, SW4, SW7, SW2, SW5, and SW8 are turned on, and SW3, SW6, and SW9 are turned off. At this time, the inverting input terminal of Amp1 is connected to the output terminal of Amp1, and Amp1 operates as a circuitry-gain buffer; the inverting input terminal of Amp2 is connected to the output terminal of Amp2, and Amp2 operates as a circuitry-gain buffer; the inverting input terminal of Amp3 is connected to the output terminal of Amp3, and Amp3 operates as a circuitry-gain buffer;

In the integration stage Tsen, S, S4, and S7 are at a low level, S2, S5, and S8 are at a high level, S3, S6, and S9 are at a low level, SW1, SW4, and SW7 are turned off, and SW2, SW5, and SW8 are kept on, SW3, SW6, and SW9 are turned off, G1 and G2 output high levels, and T1 and T2 are turned on. The pixel current Ip (at this time, Vdata is written to DATA and Vref is written to SL, so the gate-source voltage of T3 is equal to (Vdata-Vref). Since Vdata and Vref are constant within a detection time TD, Ip is constant during the detection time TD) is written to the drain of M1, and the current mirror including M1, M3, M5, and M7 works. The source of M7 outputs Ip/2 to the inverting input terminal of Amp1, the source of M5 outputs Ip to the inverting input terminal of Amp2, and the source of M3 outputs 2Ip to the inverting input terminal of Amp3. The inverting input terminal of Amp1 is connected to the output terminal of Amp1 via C1. Amp1 operates as a current integrator and integrates Ip/2. Because a duration ΔT of the integration stage Tsen is constant (ΔT is also the integration time), the amount of accumulated current is constant. The potential at the point A1 is kept at Vref due to the virtual-short characteristic of Amp1, so the potential at the point B1 is increased due to the increasing potential difference between the two terminals of C1, and the resulted voltage at B1 is the first detection voltage VD1. Furthermore, since SW2 is turned on, the potential at the first terminal of C2 is VD1. The inverting input terminal of Amp2 is connected to the output terminal of Amp2 via C2. Amp2 operates as a current integrator and integrates Ip. Because the duration ΔT of the integration stage Tsen is constant (ΔT is also the integration time), the amount of accumulated current is constant. The potential at the point A2 is kept at Vref due to the virtual-short characteristic of Amp2, so the potential at the point B2 is increased due to the increasing potential difference between the two terminals of C2, and the resulted voltage at B2 is the second detection voltage VD2. Furthermore, since SW5 is turned on, the potential at the first terminal of C4 is VD2. The inverting input terminal of Amp3 is connected to the output terminal of Amp3 via C3. Amp3 operates as a current integrator and integrates 2Ip. Because the duration ΔT of the integration stage Tsen is constant (ΔT is also the integration time), the amount of accumulated current is constant. The potential at the point A3 is kept at Vref due to the virtual-short characteristic of Amp1, so the potential at the point B3 is increased due to the increasing potential difference between the two terminals of C3, and the resulted voltage at B3 is the third detection voltage VD3. Furthermore, since SW8 is turned on, the potential at the first terminal of C6 is VD3;

in the sampling stage Tsam, G1 and G2 continue to output high level, T1 and T2 are turned on; S1, S4, S7, S2, S5, and S8 are at a low level, SW1, SW4, SW7, SW2, SW5 and SW8 are turned off;

in the first sampling period Ts1 included in Tsam, SW3 is turned on, SW6 and SW9 are turned off, VD1 stored in C2 is provided to the ADC via the SW3 that is turned on, and the ADC converts VD1 to the corresponding first digital voltage Vdig1;

in the second sampling period Ts2 included in Tsam, SW6 is turned on, SW3 and SW9 are turned off, VD2 stored in C4 is provided to the ADC via the SW5 that is turned on, and the ADC converts VD2 to the corresponding second digital voltage Vdig2;

in the third sampling period Ts3 included in Tsam, SW9 is turned on, SW3 and SW6 are turned off, VD3 stored in C6 is provided to the ADC via the SW8 that is turned on, and the ADC converts VD3 to the corresponding third digital voltage Vdig3;

The comparator (not shown in FIG. 9) determines whether Vdig2 is too large or too small. When the comparator determines that Vdig2 is too large, it transfers Vdig1 to the pixel current acquisition circuit (not shown in FIG. 9), and the pixel current acquisition circuit calculates the pixel current according to Vdig1. When the comparator determines that Vdig2 is too small, it transfers Vdig3 to the pixel current acquisition circuit (not shown in FIG. 9), and the pixel current acquisition circuit calculates the pixel current according to Vdig3. When the comparator determines that the second detection voltage is within the detection range of the ADC according to Vdig2, it transfers the Vdig2 to the pixel current acquisition circuit (not shown in FIG. 9), and the pixel current acquisition circuit calculates the pixel current according to Vdig2. After the pixel current is calculated, a compensation to the threshold voltage and mobility of the driving transistor T3 can be performed according to the pixel current.

In practice, the comparator and the pixel current acquisition circuit may be provided in a timing controller.

When the embodiment of the pixel current detection circuit according to the present disclosure shown in FIG. 9 is in operation, the pixel current obtained according to VD1 is equal to $2\times C1\times(Vref-VD1)/^{\Delta}T$; $^{\Delta}T$;

the pixel current obtained according to VD2 is equal to $C1\times(Vref-VD2)/^{\Delta}T$;

the pixel current obtained according to VD3 is equal to $C1\times(Vref-VD3)/2^{\Delta}T$;

When the embodiment of the pixel current detection circuit according to the present disclosure shown in FIG. 9 is in operation, if VD2 exceeds the detection range of the ADC (that is, when VD2 is higher than the maximum detection voltage of the ADC), Vdig1 corresponding to VD1 is read out, which can solve the problem that Ip is too large so that the data read by the ADC exceeds the detection range of the ADC; if VD2 is too small, Vdig3 corresponding to VD3 is read out, which can solve the problem that the ADC cannot read small data accurately.

In order to improve the detection accuracy and detection range of an OLED (organic light emitting diode) display panel, according to the embodiments of the present disclosure, firstly the pixel current Ip is converted into ½Ip, Ip, 2Ip by current mirror circuits, and these currents are then input into respective integrating circuits for current integration. The comparator may output a suitable digital voltage to the pixel current acquisition circuit according to the value of Vdig2 output by the ADC, and the pixel current acquisition circuit may detect the pixel current according to the digital voltage.

An embodiment of the present disclosure further provides a pixel current detection method for the above pixel current detection circuit. The pixel current detection method includes:

a current conversion step of converting the pixel current by the pixel current conversion circuit to obtain a first pixel current, a second pixel current and a third pixel current; and a current detection step of converting, by the current detection circuit, the first pixel current into a first detection voltage, the second pixel current into a second detection voltage, and the third pixel current into a third detection voltage, and determining the pixel current according to the first detection voltage, the second detection voltage and the third detection voltage.

The pixel current detection method according to the present disclosure uses the pixel current conversion circuit to convert the pixel current to obtain the first pixel current, the second pixel current and the third pixel current, the current detection circuit obtains the pixel current according to the first detection voltage obtained by converting the first pixel current, the second detection voltage obtained by converting the second pixel current, and the third detection voltage obtained by converting the third pixel current, so that the problem of inaccurate detection results due to the limited detection range of the current detection circuit can be avoided, and the pixel current can be detected accurately, thereby enabling better external compensation.

Optionally, the first pixel current is less than the pixel current to be detected, and the third pixel current is greater than the pixel current to be detected.

Figure 11:
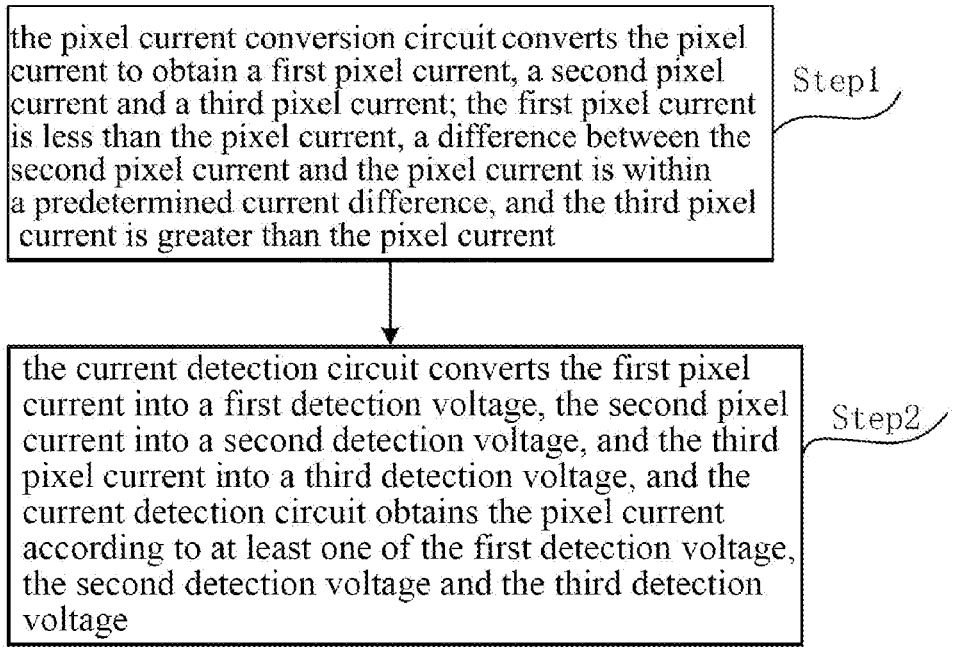
FIG. 11 is a flowchart of a pixel current detection method according to an embodiment of the present disclosure.

The pixel current detection method according to an embodiment of the present disclosure is applied to a pixel circuit, so as to detect the pixel current in the pixel circuit by using the above pixel current detection circuit. As shown in FIG. 11, the pixel current detection method includes:

a current conversion step Step1: converting the pixel current by the pixel current conversion circuit to obtain a first pixel current, a second pixel current and a third pixel current; the first pixel current is less than the pixel current, a ratio between the second pixel current to the pixel current is within a predetermined ratio range, and the third pixel current is greater than the pixel current;

a current detection step Step2: converting, by the current detection circuit, the first pixel current into a first detection voltage, the second pixel current into a second detection voltage, and the third pixel current into a third detection voltage, and determining, by the current detection circuit, the pixel current according to at least one of the first detection voltage, the second detection voltage and the third detection voltage.

The pixel current detection method according to the embodiment of the present disclosure uses the pixel current conversion circuit to convert the pixel current to obtain the first pixel current, the second pixel current and the third pixel current, the first pixel current is less than the pixel current, a ratio between the second pixel current to the pixel current is within a predetermined ratio range, and the third pixel current is greater than the pixel current, the current detection circuit obtains the pixel current according to at least one of the first detection voltage obtained by converting the first pixel current, the second detection voltage obtained by converting the second pixel current, and the third detection voltage obtained by converting the third pixel current, so that the problem of inaccurate detection results due to the limited detection range of the current detection circuit can be avoided, and the pixel current can be detected accurately, thereby enabling better external compensation.

Optionally, the current detection circuit may include a first conversion sub-circuit, a second conversion sub-circuit, a third conversion sub-circuit, and a detection sub-circuit; the current detection step may include:

receiving the first pixel current and converting the first pixel current into the first detection voltage correspondingly by the first conversion sub-circuit;

receiving the second pixel current and converting the second pixel current into the second detection voltage correspondingly by the second conversion sub-circuit;

receiving the third pixel current and converting the third pixel current into the third detection voltage correspondingly by the third conversion sub-circuit;

obtaining the pixel current according to at least one of the first, second and third detection voltages by the detection sub-circuit.

In practice, the detection sub-circuit includes an analog-to-digital converter, a comparator, and a pixel current acquisition circuit; the step of determining the pixel current according to at least one of the first, second and third detection voltages by the detection sub-circuit includes:

sampling the first detection voltage in a first sampling period included in a sampling stage and convert the first detection voltage into a first digital voltage by the analog-to-digital converter, sampling the second detection voltage in a second sampling period included in the sampling stage and convert the second detection voltage into a second digital voltage by the analog-to-digital converter, and sampling the third detection voltage in a third sampling period included in the sampling stage and convert the third detection voltage into a third digital voltage by the analog-to-digital converter;

comparing the second digital voltage with a predetermined maximum digital voltage and with a predetermined minimum digital voltage by the comparator; when the comparator determines that the second digital voltage is higher than the predetermined maximum digital voltage by comparing, the comparator transfer the first digital voltage to the pixel current acquisition circuit; when the comparator determines that the second digital voltage is lower than the predetermined minimum digital voltage, the comparator transfer the third digital voltage to the pixel current acquisition circuit; when the comparator determines that the second digital voltage is higher than or equal to the predetermined minimum digital voltage and lower than or equal to the predetermined maximum digital voltage, the comparator transfer the second digital voltage to the pixel current acquisition circuit;

calculating the pixel current according to an output result of the comparator by the pixel current acquisition circuit.

Optionally, the first conversion sub-circuit may include a first differential operational amplifier, a first storage capacitor, a second storage capacitor, a first switch, a second switch, and a third switch; the detection sub-circuit further includes a first initialization circuit; a detection time includes an initial stage, an integration stage and a sampling stage arranged in sequence; the sampling stage includes a first sampling period; the step of converting the first pixel current into the first detection voltage by the current detection circuit includes:

in the initial stage, turning on a connection between an inverting input terminal of the first differential operational amplifier and an output terminal of the first differential operational amplifier by the first switch, turning on a connection between the output terminal of the first differential operational amplifier and a first terminal of the second storage capacitor by the second switch; turning off a connection between the first terminal of the second storage capacitor and the analog-to-digital converter by the third switch; and providing a reference voltage to the inverting input terminal of the first differential operational amplifier and/or the output terminal of the first differential operational amplifier by the first initialization circuit;

in the integration stage, turning off the connection between the inverting input terminal of the first differential operational amplifier and the output terminal of the first differential operational amplifier by the first switch, turning on the connection between the output terminal of the first differential operational amplifier and the first terminal of the second storage capacitor by the second switch, turning off the connection between the first terminal of the second storage capacitor and the analog-to-digital converter by the third switch, and charging the first storage capacitor with the first pixel current;

in the sampling stage, turning off the connection between the inverting input terminal of the first differential operational amplifier and the output terminal of the first differential operational amplifier by the first switch, and turning off the connection between the output terminal of the first differential operational amplifier and the first terminal of the second storage capacitor by the second switch; wherein in the first sampling period, the third switch turns on the connection between the first terminal of the second storage capacitor and the analog-to-digital converter, the analog-to-digital converter samples a voltage at the first terminal of the second storage capacitor, which is the first detection voltage;

in a period included in the sampling stage except for the first sampling period, the third switch turns off the connection between the first terminal of the second storage capacitor and the analog-to-digital converter.

Optionally, the second conversion sub-circuit may include a second differential operational amplifier, a third storage capacitor, a fourth storage capacitor, a fourth switch, a fifth switch, and a sixth switch; the detection sub-circuit further includes a second initialization circuit; a detection time includes an initial stage, an integration stage and a sampling stage arranged in sequence; the sampling stage further includes a second sampling period;

the step of converting the second pixel current into the second detection voltage by the current detection circuit includes:

in the initial stage, turning on a connection between an inverting input terminal of the second differential operational amplifier and an output terminal of the second differential operational amplifier by the fourth switch, turning on a connection between the output terminal of the second differential operational amplifier and a first terminal of the fourth storage capacitor by the fifth switch; turning off a connection between the first terminal of the fourth storage capacitor and the analog-to-digital converter by the sixth switch; and providing a reference voltage to the inverting input terminal of the second differential operational amplifier and/or the output terminal of the second differential operational amplifier by the second initialization circuit;

in the integration stage, turning off the connection between the inverting input terminal of the second differential operational amplifier and the output terminal of the second differential operational amplifier by the fourth switch, turning on the connection between the output terminal of the second differential operational amplifier and the first terminal of the fourth storage capacitor by the fifth switch, turning off the connection between the first terminal of the fourth storage capacitor and the analog-to-digital converter by the sixth switch, and charging the third storage capacitor with the second pixel current;

in the sampling stage, turning off the connection between the inverting input terminal of the second differential operational amplifier and the output terminal of the second differential operational amplifier by the fourth switch, and turning off the connection between the output terminal of the second differential operational amplifier and the first terminal of the fourth storage capacitor by the fifth switch; wherein in the second sampling period, the sixth switch turns on the connection between the first terminal of the fourth storage capacitor and the analog-to-digital converter, the analog-to-digital converter samples a voltage at the first terminal of the fourth storage capacitor, which is the second detection voltage;

in a period included in the sampling stage except for the second sampling period, the sixth switch turns off the connection between the first terminal of the fourth storage capacitor and the analog-to-digital converter.

Optionally, the third conversion sub-circuit may include a third differential operational amplifier, a fifth storage capacitor, a sixth storage capacitor, a seventh switch, an eighth switch, and a ninth switch; the detection sub-circuit further includes a third initialization circuit; a detection time includes an initial stage, an integration stage and a sampling stage arranged in sequence; the sampling stage further includes a third sampling period;

the step of converting the third pixel current into the third detection voltage by the current detection circuit comprises:

in the initial stage, turning on a connection between an inverting input terminal of the third differential operational amplifier and an output terminal of the third differential operational amplifier by the seventh switch, turning on a connection between the output terminal of the third differential operational amplifier and a first terminal of the sixth storage capacitor by the eighth switch; turning off a connection between the first terminal of the sixth storage capacitor and the analog-to-digital converter by the ninth switch; and providing a reference voltage to the inverting input terminal of the third differential operational amplifier and/or the output terminal of the third differential operational amplifier by the third initialization circuit;

in the integration stage, turning off the connection between the inverting input terminal of the third differential operational amplifier and the output terminal of the third differential operational amplifier by the seventh switch, turning on the connection between the output terminal of the third differential operational amplifier and the first terminal of the sixth storage capacitor by the eighth switch, turning off the connection between the first terminal of the sixth storage capacitor and the analog-to-digital converter by the ninth switch, and charging the fifth storage capacitor with the third pixel current;

in the sampling stage, turning off the connection between the inverting input terminal of the third differential operational amplifier and the output terminal of the third differential operational amplifier by the seventh switch, and turning off the connection between the output terminal of the third differential operational amplifier and the first terminal of the sixth storage capacitor by the eighth switch; wherein in the third sampling period, the ninth switch turns on the connection between the first terminal of the sixth storage capacitor and the analog-to-digital converter, the analog-to-digital converter samples a voltage at the first terminal of the sixth storage capacitor, which is the third detection voltage;

in a period included in the sampling stage except for the third sampling period, the ninth switch turns off the connection between the first terminal of the sixth storage capacitor and the analog-to-digital converter.

A display device according to an embodiment of the present disclosure includes the above pixel current detection circuit; the display device further includes a pixel circuit;

the pixel current detection circuit is configured to detect a pixel current in the pixel circuit.

Figure 12:
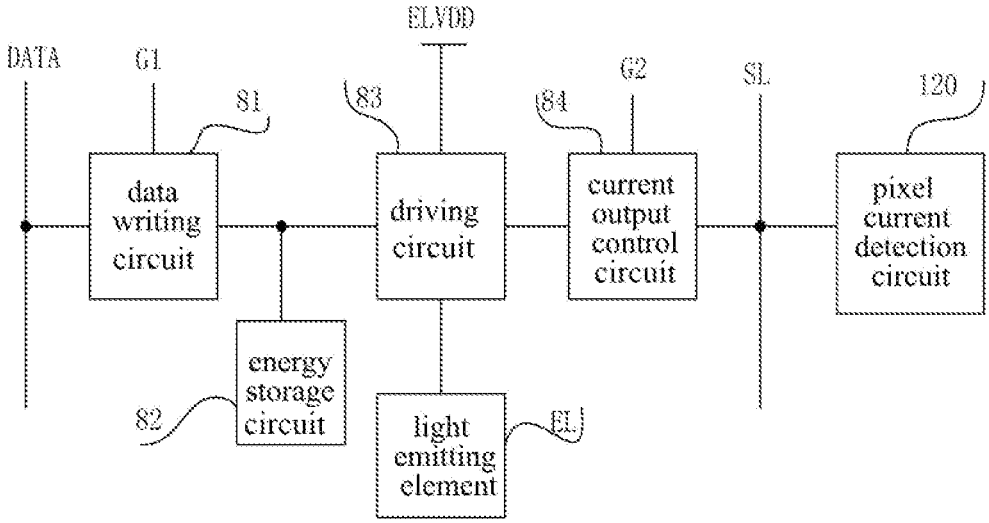
FIG. 12 is a structural block diagram of a display device according to an embodiment of the present disclosure.

Optionally, as shown in FIG. 12, the pixel circuit may include a data writing circuit 81, an energy storage circuit 82, a driving circuit 83, a light emitting element EL, and a current output control circuit 84;

a control terminal of the data writing circuit 81 is connected to a first scanning line G1, a first terminal of the data writing circuit 81 is connected to a data line DATA, a second terminal of the data writing circuit 81 is connected to a control terminal of the driving circuit 83, and the data writing circuit 81 is configured to turn on or turn off a connection between the data line DATA and the control terminal of the driving circuit 83 under control of the first scanning line G1;

the energy storage circuit 82 is connected to the control terminal of the driving circuit 83 to control a potential of the control terminal of the driving circuit 83;

a first terminal of the driving circuit 83 is connected to a power supply voltage terminal, a second terminal of the driving circuit 83 is connected to the light emitting element EL, and the driving circuit 83 is configured to drive the light emitting element EL to emit light under control of the control terminal thereof, the power supply voltage terminal is used to output a positive power supply voltage ELVDD;

a control terminal of the current output control circuit 84 is connected to a second scanning line G2, a first terminal of the current output control circuit 84 is connected to the second terminal of the driving circuit 83, a second terminal of the current output control circuit 84 is connected to an external compensation line SL;

the pixel current conversion circuit (not shown in FIG. 12) in the pixel current detection circuit 120 is connected to the external compensation line SL, and configured to detect the pixel current output from the external compensation line SL.

Optionally, the light emitting element EL may be an organic light emitting diode OLED. The anode of the OLED is connected to the second terminal of the driving circuit 83. The cathode of the OLED may receive a negative power supply voltage. The energy storage circuit 82 may include a display storage capacitor. The data writing circuit may include a data writing transistor, the driving circuit 83 may include a driving transistor, and the current output control circuit may include a current output control transistor.

The display device provided in the embodiment of the present disclosure may be any product or component having a display function, such as a mobile phone, a tablet computer, a television, a display, a notebook computer, a digital photo frame, a navigator, and the like.

The above are the preferred embodiments of the present disclosure. It should be noted that, for those of ordinary skill in the art, without departing from the principles described in the present disclosure, many improvements and retouches can be made, and should also be regarded as the scope of protection of this disclosure.

What is claimed is:

1. A pixel current detection circuit applied to a pixel circuit, comprising:

a pixel current conversion circuit which obtains a first pixel current, a second pixel current and a third pixel current according to an input pixel current to be detected, wherein a ratio of the first pixel current to the second pixel current and a ratio of the second pixel current to the third pixel current are predetermined values; and a current detection circuit connected to the pixel current conversion circuit, wherein the current detection circuit converts the first pixel current into a first detection voltage, converts the second pixel current into a second detection voltage, and converts the third pixel current into a third detection voltage, and determines the pixel current according to the first detection voltage, the second detection voltage and the third detection voltage.

2. The pixel current detection circuit according to claim 1, wherein the current detection circuit comprises a first conversion sub-circuit, a second conversion sub-circuit, a third conversion sub-circuit, and a detection sub-circuit;

the first conversion sub-circuit is connected to the pixel current conversion circuit to receive the first pixel current, and converts the first pixel current into the first detection voltage;

the second conversion sub-circuit is connected to the pixel current conversion circuit to receive the second pixel current, and converts the second pixel current into the second detection voltage;

the third conversion sub-circuit is connected to the pixel current conversion circuit to receive the third pixel current, and converts the third pixel current into the third detection voltage;

the detection sub-circuit is connected with the first, second and third conversion sub-circuits, and is configured to determine the pixel current according to the first, second and third detection voltages.

3. The pixel current detection circuit according to claim 2, wherein the detection sub-circuit further comprises an analog-to-digital converter, a comparator, and a pixel current acquisition circuit;

the analog-to-digital converter is configured to sample the first detection voltage in a first sampling period of a sampling stage and convert the first detection voltage into a first digital voltage, to sample the second detection voltage in a second sampling period of the sampling stage and convert the second detection voltage into a second digital voltage, and to sample the third detection voltage in a third sampling period of the sampling stage and convert the third detection voltage into a third digital voltage;

the comparator is configured to compare the second digital voltage with a predetermined maximum digital voltage and with a predetermined minimum digital voltage, and to output the first digital voltage when the second digital voltage is higher than the predetermined maximum digital voltage, to output the third digital voltage when the second digital voltage is lower than the predetermined minimum digital voltage, and to output the second digital voltage when the second digital voltage is higher than or equal to the predetermined minimum digital voltage and lower than or equal to the predetermined maximum digital voltage;

the pixel current acquisition circuit is configured to calculate the pixel current according to an output result of the comparator.

4. The pixel current detection circuit according to claim 3, wherein the pixel current conversion circuit comprises a first pixel current output terminal for outputting the first pixel current;

the first conversion sub-circuit comprises a first differential operational amplifier, a first storage capacitor, a second storage capacitor, a first switch, a second switch, and a third switch; the detection sub-circuit further comprises a first initialization circuit;

an inverting input terminal of the first differential operational amplifier is connected to the first pixel current output terminal, a non-inverting input terminal of the first differential operational amplifier is connected to a reference voltage input terminal; the reference voltage input terminal is used to input a reference voltage;

the first switch and the first storage capacitor are connected in parallel between the inverting input terminal of the first differential operational amplifier and an output terminal of the first differential operational amplifier;

the output terminal of the first differential operational amplifier is connected to a first terminal of the second switch, a second terminal of the second switch is connected to a first terminal of the third switch, a second terminal of the third switch is connected to the analog-to-digital converter;

a first terminal of the second storage capacitor is connected to the second terminal of the second switch, a second terminal of the second storage capacitor is connected to a first voltage input terminal;

the first initialization circuit is configured to provide the reference voltage to the inverting input terminal of the first differential operational amplifier and/or the output terminal of the first differential operational amplifier in an initial stage;

the first switch is configured to turn on or turn off a connection between the inverting input terminal of the first differential operational amplifier and the output terminal of the first differential operational amplifier;

the second switch is configured to turn on or turn off a connection between the output terminal of the first differential operational amplifier and the first terminal of the second storage capacitor;

the third switch is configured to turn on or turn off a connection between the first terminal of the second storage capacitor and the analog-to-digital converter.

5. The pixel current detection circuit according to claim 4, wherein the first switch is configured to turn on, in the initial stage, the connection between the inverting input terminal of the first differential operational amplifier and the output terminal of the first differential operational amplifier, and to turn off, in an integration stage and the sampling stage, the connection between the inverting input terminal of the first differential operational amplifier and the output terminal of the first differential operational amplifier;

the second switch is configured to turn on, in the initial stage and the integration stage, the connection between the output terminal of the first differential operational amplifier and the first terminal of the second storage capacitor, and to turn off, in the sampling stage, the connection between the output terminal of the first differential operational amplifier and the first terminal of the second storage capacitor;

the third switch is configured to turn off, in the initial stage, the integration stage and the sampling stage except for the first sampling period, the connection between the first terminal of the second storage capacitor and the analog-to-digital converter, and to turn on the connection between the first terminal of the second storage capacitor and the analog-to-digital converter in the first sampling period.

6. The pixel current detection circuit according to claim 3, wherein the pixel current conversion circuit comprises a second pixel current output terminal for outputting the second pixel current;

the second conversion sub-circuit comprises a second differential operational amplifier, a third storage capacitor, a fourth storage capacitor, a fourth switch, a fifth switch, and a sixth switch; the detection sub-circuit further comprises a second initialization circuit;

an inverting input terminal of the second differential operational amplifier is connected to the second pixel current output terminal, a non-inverting input terminal of the second differential operational amplifier is connected to a reference voltage input terminal; the reference voltage input terminal is used to input a reference voltage;

the fourth switch and the third storage capacitor are connected in parallel between the inverting input terminal of the second differential operational amplifier and an output terminal of the second differential operational amplifier;

the output terminal of the second differential operational amplifier is connected to a first terminal of the fifth switch, a second terminal of the fifth switch is connected to a first terminal of the sixth switch, a second terminal of the sixth switch is connected to the analog-to-digital converter;

a first terminal of the fourth storage capacitor is connected to the second terminal of the fifth switch, a second terminal of the fourth storage capacitor is connected to a first voltage input terminal;

the second initialization circuit is configured to provide the reference voltage to the inverting input terminal of the second differential operational amplifier and/or the output terminal of the second differential operational amplifier in the initial stage;

the fourth switch is configured to turn on or turn off a connection between the inverting input terminal of the second differential operational amplifier and the output terminal of the second differential operational amplifier;

the fifth switch is configured to turn on or turn off a connection between the output terminal of the second differential operational amplifier and the first terminal of the fourth storage capacitor;

the sixth switch is configured to turn on or turn off a connection between the first terminal of the fourth storage capacitor and the analog-to-digital converter.

7. The pixel current detection circuit according to claim 6, wherein the fourth switch is configured to turn on, in the initial stage, the connection between the inverting input terminal of the second differential operational amplifier and the output terminal of the second differential operational amplifier, and to turn off, in an integration stage and the sampling stage, the connection between the inverting input terminal of the second differential operational amplifier and the output terminal of the second differential operational amplifier;

the fifth switch is configured to turn on, in the initial stage and the integration stage, the connection between the output terminal of the second differential operational amplifier and the first terminal of the fourth storage capacitor, and to turn off the connection between the output terminal of the second differential operational amplifier and the first terminal of the fourth storage capacitor in the sampling stage;

the sixth switch is configured to turn off, in the initial stage, the integration stage and the sampling stage except for the second sampling period, the connection between the first terminal of the fourth storage capacitor and the analog-to-digital converter, and to turn on the connection between the first terminal of the fourth storage capacitor and the analog-to-digital converter in the second sampling period.

8. The pixel current detection circuit according to claim 3, wherein the pixel current conversion circuit comprises a third pixel current output terminal for outputting the third pixel current;

the third conversion sub-circuit comprises a third differential operational amplifier, a fifth storage capacitor, a sixth storage capacitor, a seventh switch, an eighth switch, and a ninth switch; the detection sub-circuit further comprises a third initialization circuit;

an inverting input terminal of the third differential operational amplifier is connected to the third pixel current output terminal, a non-inverting input terminal of the third differential operational amplifier is connected to a reference voltage input terminal; the reference voltage input terminal is used to input a reference voltage;

the seventh switch and the fifth storage capacitor are connected in parallel between the inverting input terminal of the third differential operational amplifier and an output terminal of the third differential operational amplifier;

the output terminal of the third differential operational amplifier is connected to a first terminal of the eighth switch, a second terminal of the eighth switch is connected to a first terminal of the ninth switch, a second terminal of the ninth switch is connected to the analog-to-digital converter;

a first terminal of the sixth storage capacitor is connected to the second terminal of the eighth switch, a second terminal of the sixth storage capacitor is connected to a first voltage input terminal;

the third initialization circuit is configured to provide the reference voltage to the inverting input terminal of the third differential operational amplifier and/or the output terminal of the third differential operational amplifier in the initial stage;

the seventh switch is configured to turn on or turn off a connection between the inverting input terminal of the third differential operational amplifier and the output terminal of the third differential operational amplifier;

the eighth switch is configured to turn on or turn off a connection between the output terminal of the third differential operational amplifier and the first terminal of the sixth storage capacitor;

the ninth switch is configured to turn on or turn off a connection between the first terminal of the sixth storage capacitor and the analog-to-digital converter.

9. The pixel current detection circuit according to claim 8, wherein the seventh switch is configured to turn on, in the initial stage, the connection between the inverting input terminal of the third differential operational amplifier and the output terminal of the third differential operational amplifier, and to turn off, in an integration stage and the sampling stage, the connection between the inverting input terminal of the third differential operational amplifier and the output terminal of the third differential operational amplifier;

the eighth switch is configured to turn on, in the initial stage and the integration stage, the connection between the output terminal of the third differential operational amplifier and the first terminal of the sixth storage capacitor, and to turn off the connection between the output terminal of the third differential operational amplifier and the first terminal of the sixth storage capacitor in the sampling stage;

the ninth switch is configured to turn off, in the initial stage, the integration stage and the sampling stage except for the third sampling period, the connection between the first terminal of the sixth storage capacitor and the analog-to-digital converter, and to turn on the connection between the first terminal of the sixth storage capacitor and the analog-to-digital converter in the third sampling period.

10. The pixel current detection circuit according to claim 1, wherein the pixel current conversion circuit comprises:

an input transistor having a gate and a first electrode connected to the pixel current, and a second electrode connected to a second voltage input terminal;

a first power-supply transistor having a gate and a first electrode connected to a third voltage input terminal;

a first output transistor having a gate connected to the gate of the input transistor, a first electrode connected to a second electrode of the first power-supply transistor, and a second electrode for outputting the first pixel current;

a second power-supply transistor having a gate and a first electrode connected to the third voltage input terminal;

a second output transistor having a gate connected to the gate of the input transistor, a first electrode connected to a second electrode of the second power-supply transistor, and a second electrode for outputting the second pixel current;

a third power-supply transistor having a gate and a first electrode connected to the third voltage input terminal;

a third output transistor having a gate connected to the gate of the input transistor, a first electrode connected to a second electrode of the third power-supply transistor, and a second electrode for outputting the third pixel current; wherein a ratio of a width-to-length ratio of the first output transistor to a width-to-length ratio of the input transistor is less than 1, and a ratio of a width-to-length ratio of the third output transistor to the width-to-length ratio of the input transistor is greater than 1.

11. The pixel current detection circuit according to claim 10, wherein a ratio of a width-to-length ratio of the second output transistor to the width-to-length ratio of the input transistor is in a range greater than or equal to 0.99 and less than or equal to 1.01; the ratio of the width-to-length ratio of the first output transistor to the width-to-length ratio of the input transistor is greater than 0 and less than 0.6, and the ratio of the width-to-length ratio of the third output transistor to the width-to-length ratio of the input transistor is greater than 1.5.

12. A pixel current detection method applied to the pixel current detection circuit according to claim 1, comprising:

a current conversion step of converting the pixel current by the pixel current conversion circuit to obtain a first pixel current, a second pixel current and a third pixel current; and a current detection step of converting, by the current detection circuit, the first pixel current into a first detection voltage, the second pixel current into a second detection voltage, and the third pixel current into a third detection voltage, and determining the pixel current according to the first detection voltage, the second detection voltage and the third detection voltage.

13. The pixel current detection method according to claim 12, wherein the first pixel current is less than the second pixel current, the third pixel current is greater than the second pixel current;

the current detection circuit comprises a first conversion sub-circuit, a second conversion sub-circuit, a third conversion sub-circuit, and a detection sub-circuit; the current detection step comprises:

receiving the first pixel current and converting the first pixel current into the first detection voltage by the first conversion sub-circuit;

receiving the second pixel current and converting the second pixel current into the second detection voltage by the second conversion sub-circuit;

receiving the third pixel current and converting the third pixel current into the third detection voltage by the third conversion sub-circuit;

determining the pixel current according to the first, second and third detection voltages by the detection sub-circuit.

14. The pixel current detection method according to claim 13, wherein the detection sub-circuit further comprises an analog-to-digital converter, a comparator, and a pixel current acquisition circuit; the step of determining the pixel current according to the first, second and third detection voltages by the detection sub-circuit comprises:

sampling the first detection voltage in a first sampling period of a sampling stage and converting the first detection voltage into a first digital voltage by the analog-to-digital converter, sampling the second detection voltage in a second sampling period of the sampling stage and converting the second detection voltage into a second digital voltage by the analog-to-digital converter, and sampling the third detection voltage in a third sampling period of the sampling stage and converting the third detection voltage into a third digital voltage by the analog-to-digital converter;

comparing the second digital voltage with a predetermined maximum digital voltage and with a predetermined minimum digital voltage by the comparator, and outputting the first digital voltage when the second digital voltage is higher than the predetermined maximum digital voltage, outputting the third digital voltage when the second digital voltage is lower than the predetermined minimum digital voltage, and outputting the second digital voltage when the second digital voltage is higher than or equal to the predetermined minimum digital voltage and lower than or equal to the predetermined maximum digital voltage; and calculating, by the pixel current acquisition circuit, the pixel current according to an output result of the comparator.

15. The pixel current detection method according to claim 14, wherein the first conversion sub-circuit comprises a first differential operational amplifier, a first storage capacitor, a second storage capacitor, a first switch, a second switch, and a third switch; the detection sub-circuit further comprises a first initialization circuit; a detection time comprises an initial stage, an integration stage and a sampling stage arranged in sequence; the sampling stage comprises a first sampling period; the step of converting the first pixel current into the first detection voltage by the current detection circuit comprises:

in the initial stage, turning on a connection between an inverting input terminal of the first differential operational amplifier and an output terminal of the first differential operational amplifier by the first switch, turning on a connection between the output terminal of the first differential operational amplifier and a first terminal of the second storage capacitor by the second switch; turning off a connection between the first terminal of the second storage capacitor and the analog-to-digital converter by the third switch; and providing a reference voltage to the inverting input terminal of the first differential operational amplifier and/or the output terminal of the first differential operational amplifier by the first initialization circuit;

in the integration stage, turning off the connection between the inverting input terminal of the first differential operational amplifier and the output terminal of the first differential operational amplifier by the first switch, turning on the connection between the output terminal of the first differential operational amplifier and the first terminal of the second storage capacitor by the second switch, turning off the connection between the first terminal of the second storage capacitor and the analog-to-digital converter by the third switch, and charging the first storage capacitor with the first pixel current;

in the sampling stage, turning off the connection between the inverting input terminal of the first differential operational amplifier and the output terminal of the first differential operational amplifier by the first switch, and turning off the connection between the output terminal of the first differential operational amplifier and the first terminal of the second storage capacitor by the second switch; wherein in the first sampling period, the third switch turns on the connection between the first terminal of the second storage capacitor and the analog-to-digital converter, the analog-to-digital converter samples a voltage at the first terminal of the second storage capacitor, which is the first detection voltage; and in the sampling stage except for the first sampling period, the third switch turns off the connection between the first terminal of the second storage capacitor and the analog-to-digital converter.

16. The pixel current detection method according to claim 14, wherein the second conversion sub-circuit comprises a second differential operational amplifier, a third storage capacitor, a fourth storage capacitor, a fourth switch, a fifth switch, and a sixth switch; the detection sub-circuit further comprises a second initialization circuit; a detection time comprises an initial stage, an integration stage and a sampling stage arranged in sequence; the sampling stage further comprises a second sampling period;

the step of converting the second pixel current into the second detection voltage by the current detection circuit comprises:

in the initial stage, turning on a connection between an inverting input terminal of the second differential operational amplifier and an output terminal of the second differential operational amplifier by the fourth switch, turning on a connection between the output terminal of the second differential operational amplifier and a first terminal of the fourth storage capacitor by the fifth switch; turning off a connection between the first terminal of the fourth storage capacitor and the analog-to-digital converter by the sixth switch; and providing a reference voltage to the inverting input terminal of the second differential operational amplifier and/or the output terminal of the second differential operational amplifier by the second initialization circuit;

in the integration stage, turning off the connection between the inverting input terminal of the second differential operational amplifier and the output terminal of the second differential operational amplifier by the fourth switch, turning on the connection between the output terminal of the second differential operational amplifier and the first terminal of the fourth storage capacitor by the fifth switch, turning off the connection between the first terminal of the fourth storage capacitor and the analog-to-digital converter by the sixth switch, and charging the third storage capacitor with the second pixel current;

in the sampling stage, turning off the connection between the inverting input terminal of the second differential operational amplifier and the output terminal of the second differential operational amplifier by the fourth switch, and turning off the connection between the output terminal of the second differential operational amplifier and the first terminal of the fourth storage capacitor by the fifth switch; wherein in the second sampling period, the sixth switch turns on the connection between the first terminal of the fourth storage capacitor and the analog-to-digital converter, the analog-to-digital converter samples a voltage at the first terminal of the fourth storage capacitor, which is the second detection voltage; and in the sampling stage except for the second sampling period, the sixth switch turns off the connection between the first terminal of the fourth storage capacitor and the analog-to-digital converter.

17. The pixel current detection method according to claim 14, wherein the third conversion sub-circuit comprises a third differential operational amplifier, a fifth storage capacitor, a sixth storage capacitor, a seventh switch, an eighth switch, and a ninth switch; the detection sub-circuit further comprises a third initialization circuit; a detection time comprises an initial stage, an integration stage and a sampling stage arranged in sequence; the sampling stage further comprises a third sampling period;

the step of converting the third pixel current into the third detection voltage by the current detection circuit comprises:

in the initial stage, turning on a connection between an inverting input terminal of the third differential operational amplifier and an output terminal of the third differential operational amplifier by the seventh switch, turning on a connection between the output terminal of the third differential operational amplifier and a first terminal of the sixth storage capacitor by the eighth switch; turning off a connection between the first terminal of the sixth storage capacitor and the analog-to-digital converter by the ninth switch; and providing a reference voltage to the inverting input terminal of the third differential operational amplifier and/or the output terminal of the third differential operational amplifier by the third initialization circuit;

in the integration stage, turning off the connection between the inverting input terminal of the third differential operational amplifier and the output terminal of the third differential operational amplifier by the seventh switch, turning on the connection between the output terminal of the third differential operational amplifier and the first terminal of the sixth storage capacitor by the eighth switch, turning off the connection between the first terminal of the sixth storage capacitor and the analog-to-digital converter by the ninth switch, and charging the fifth storage capacitor with the third pixel current;

in the sampling stage, turning off the connection between the inverting input terminal of the third differential operational amplifier and the output terminal of the third differential operational amplifier by the seventh switch, and turning off the connection between the output terminal of the third differential operational amplifier and the first terminal of the sixth storage capacitor by the eighth switch; wherein in the third sampling period, the ninth switch turns on the connection between the first terminal of the sixth storage capacitor and the analog-to-digital converter, the analog-to-digital converter samples a voltage at the first terminal of the sixth storage capacitor, which is the third detection voltage;

in the sampling stage except for the third sampling period, the ninth switch turns off the connection between the first terminal of the sixth storage capacitor and the analog-to-digital converter.

18. A display device comprising the pixel current detection circuit according to claim 1, further comprising a pixel circuit; wherein the pixel current detection circuit is configured to detect a pixel current in the pixel circuit.

19. The display device according to claim 18, wherein the pixel circuit comprises a data writing circuit, an energy storage circuit, a driving circuit, a light emitting element, and a current output control circuit;

a control terminal of the data writing circuit is connected to a first scanning line, a first terminal of the data writing circuit is connected to a data line, a second terminal of the data writing circuit is connected to a control terminal of the driving circuit, and the data writing circuit is configured to turn on or turn off a connection between the data line and the control terminal of the driving circuit under control of the first scanning line;

the energy storage circuit is connected to the control terminal of the driving circuit to control a potential of the control terminal of the driving circuit;

a first terminal of the driving circuit is connected to a power supply voltage terminal, a second terminal of the driving circuit is connected to the light emitting element, and the driving circuit is configured to drive, under control of the control terminal of the driving circuit, the light emitting element to emit light;

a control terminal of the current output control circuit is connected to a second scanning line, a first terminal of the current output control circuit is connected to the second terminal of the driving circuit, a second terminal of the current output control circuit is connected to an external compensation line;

the pixel current conversion circuit in the pixel current detection circuit is connected to the external compensation line, and configured to detect the pixel current output from the external compensation line.

* * * * *